US006682070B1

(12) United States Patent
Rosenfeld et al.

(10) Patent No.: US 6,682,070 B1
(45) Date of Patent: Jan. 27, 2004

(54) MAGNETIC TABLE HOCKEY

(76) Inventors: Gerald Rosenfeld, P.O. Box 369, 31 Broad St., Branchville, NJ (US) 07826; Penny Hope Rosenfeld, P.O. Box 369, 31 Broad St., Branchville, NJ (US) 07826

( * ) Notice: Subject to any disclaimer, the term of this patent is extended or adjusted under 35 U.S.C. 154(b) by 0 days.

(21) Appl. No.: 10/349,893

(22) Filed: Jan. 23, 2003

(51) Int. Cl.[7] ..... A63F 7/06
(52) U.S. Cl. ..... 273/108.1; 273/108.52
(58) Field of Search ..... 273/108, 108.1, 273/108.51–108.56, 126 R, 126 A

(56) References Cited

U.S. PATENT DOCUMENTS 3,785,648 A * 1/1974 Kobayashi ..... 273/108.51
4,834,371 A * 5/1989 Hay et al. ..... 273/108.51
5,016,878 A * 5/1991 Hay et al. ..... 273/108.51
6,189,885 B1 * 2/2001 Hamot ..... 273/108.1
6,450,497 B1 * 9/2002 Bialler et al. ..... 273/108.1
6,457,710 B1 * 10/2002 Bisbee et al. ..... 273/108.1
6,478,299 B2 * 11/2002 Bialler et al. ..... 273/108.1
6,561,511 B1 * 5/2003 Vaysberg et al. ..... 273/108.56
2002/0140167 A1 * 10/2002 Bialler et al. ..... 273/108.56

* cited by examiner

*Primary Examiner*—Raleigh W. Chiu

(57) ABSTRACT

A game such as a tabletop hockey game that is comprised of a smooth, substantially planar playing surface defined by a raised border, having goal cavities at each end and suspended by a framing assembly over a base. Actuators located under the bottom of the playing surface are movable by control rods and by foot operated cable devices, said actuators include first coupling magnets. The game also has object propelling elements that are movable over the top of the playing surface, and propelled object blocking elements that move from side to side over the playing surface in front of the goal cavities, said elements include second coupling magnets. A game wherein the first and second magnets coupled through the playing surface so that movement of the actuators results in a corresponding movement of the object propelling and propelled object blocking elements to propel and block a playing object.

33 Claims, 17 Drawing Sheets

MAGNETIC TABLE HOCKEY

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTOR PROGRAM LISTING COMPACT DISK APPENDIX

Not Applicable

BACKGROUND OF THE INVENTION

The present invention is directed to magnetic tabletop games and is particularly directed to magnetic tabletop hockey games.

There exists a wide variety of manually operated tabletop games whereby control rods, handles and steering wheels are used in conjunction with magnets to maneuver game playing pieces around a playing surface. These game playing pieces in turn engage a playing object, such as a ball or puck, in an attempt to advance it toward a goal at the opponent's end of a game table.

These games are commonly referred to as tabletop hockey, rod hockey, magnet hockey, tabletop soccer or fussball (a German word for soccer). Some examples are disclosed in U.S. Pat. No. 4,007,932, which discloses a miniature hockey game that uses magnetic attraction and steering wheels to move playing pieces over a playing surface; U.S. Pat. No. 4,474,375 discloses a tabletop hockey game that uses one control handle to move multiple playing pieces over a playing surface; U.S. Pat. No. 4,076,242 which discloses a game device with a playing surface of pressurized air, slots and rotating magnets that move playing pieces and objects over a playing surface; U.S. Pat. No. 5,275,401 which discloses a game having mobile figures and a combination of slots and magnetically driven devices to move playing pieces over a playing surface.

Although the above-identified patents provide a variety of hockey game play simulations, they all have restrictive control mechanisms that reduce the game operators play making and goal scoring options. This is a drawback, as unrestricted movement of game playing pieces is highly desirable in order to replicate the play of an actual hockey game.

Providing realistic game action is another major problem associated with today's tabletop games. For example, in existing games, the game playing pieces cannot move freely in all directions over the playing surface but are confined to movement within slots or within the limits of restrictive control mechanisms. As a result, the game operator cannot move the game playing pieces to pursue the playing object and can only engage it when it enters their limited range of movement. Another disadvantage associated with prior art is that their playing piece control devices are fixed to the perimeters of the game table. This, in conjunction with their limited range of movement, inhibits the game operator from approaching and propelling a playing object from a variety of angles; limits the game operator's ability to interact with opposing game playing pieces; limits the game operator's ability to position their game playing pieces offensively to accept or deflect a pass and their ability defensively to block a pass or shot on goal. These are all activities that would occur in an actual hockey game.

Another major drawback associated with games that utilize magnets exclusively to couple their drive mechanisms to their game playing pieces, is their inability to remain coupled when they are rapidly moved or rotated thereby, stopping game play.

Unrealistically sized playing pieces that are in proportion to their playing surface is another problem associated with games having restrictive control mechanisms. The size of the playing object (i.e. puck) and/or their playing piece shooting mechanisms (i.e. hockey stick) in these games have had to be dramatically increased to compensate for their restricted range of motion. These increases in size are necessary to insure that there are no areas on their playing surfaces where the playing object cannot be contacted, as a result the game playing pieces and/or playing objects appear out of proportion and unrealistic.

Another drawback associated with existing games involves movement and operation of the goaltender. In existing games, that utilize a goaltender, the game operator must remove at least one hand from their game playing piece controller in order to operate the goaltender mechanism. This causes a pause or disruption in the flow of the game because the game operator must make many movements when changing back and forth between an offensive and defensive posture.

Another disadvantage associated with existing games is that they are not designed to have the capability of easily changing or customizing their playing surfaces. In existing games the playing surfaces are permanently painted or printed to define game playing zones, commercial advertising, etc.

It is therefore the object of this invention to provide a new hockey type game that rectifies the deficiencies described above while adding new simulation capabilities.

SUMMARY OF THE INVENTION

The present invention was designed to provide a tabletop hockey game that can be played by one or more game operators. The game is comprised of one or more movable game playing pieces and goaltenders that travel over a smooth playing surface using permanent magnets as the driving force. The game playing pieces are movable using control rods and the goaltenders are moved by cable mechanisms. The object of the game is to propel a playing object (i.e. puck) over the playing surface, past an opponent's goaltender, into a goal.

It is the object of the present invention to provide a game that has a game playing piece that is capable of traveling in all directions, over the full length and width of the playing surface, utilizing a control rod mechanism. This freedom of movement allows the game operator to move the game playing piece to pursue, control, position and propel the playing object (i.e. puck) without restriction.

It is another object of the present invention to provide a game that has a magnetically coupled game playing piece mechanism that is capable of being rotated rapidly without dislodging from the playing surface.

It is another object of the present invention to provide a game that has a game playing piece control assembly that is structurally and mechanically designed to protect its interior rotating mechanism.

It is another object of the present invention to provide a game that has a game playing piece that includes a striking arm assembly designed to create additional forward striking momentum, increasing the velocity of the playing object when struck.

It is another object of the present invention to provide a game that has goaltender and game playing piece figurines (i.e. hockey player simulations) that mount to the goaltender and game playing piece assemblies, designed to allow the figurines to be easily removed or replaced without having to remove the assemblies.

It is another object of the present invention to provide a game that has a magnetically coupled goaltender mechanism that is capable of sliding from side to side over the playing surface in front of its goal, operated by rotating foot controlled cable mechanism. This mechanism is designed to allow the game operators to use both hands to move their game playing pieces, while simultaneously positioning their goaltender with the rotating foot mechanism, causing no disruption in game play.

It is another object of the present invention to provide a game with a game table designed to allow the game playing piece control rod to freely move, unfixed to the game table perimeter.

It is another object of the present invention to provide a game with a game table that is designed to provide a simple means for the installation or removal of the game playing piece drive mechanism.

It is another object of the present invention to provide a game with a two layer playing surface that is flat, smooth and free of holes or slots, designed so that a variety of preprinted playing surfaces can easily be inserted between the layers.

Although the present invention is directed to a tabletop hockey game, the elements comprising this invention may also be utilized for other types of games or game actions such as:

Games that require game playing pieces to have unrestricted movement over a playing surface; that are capable of interacting with opposing game playing pieces; that require goaltenders and game playing pieces to have the ability to block, control and propel a round ball. Some examples include, but are not exclusive to, soccer, field hockey and lacrosse.

Game actions that require game playing pieces that have the ability to pursue opposing game playing pieces over an entire playing surface or within zones in order to physically engage and/or dislodge them from the playing surface.

Game actions that require game playing pieces that have the ability to move over the entire playing surface or within zones, that are capable of carrying ferromagnetic playing objects attached to their magnets or repelling playing objects containing magnets having the opposite polarity as their magnets.

DETAILED DESCRIPTION OF THE INVENTION

FIGS. 1–28 show a tabletop hockey game in accordance with certain preferred embodiments of the present invention. The present invention utilizes disc-shaped rare earth permanent magnets to move the playing pieces. The game is comprised of three major supporting elements preferably constructed of non-ferromagnetic materials. The first element is an Object Propelling Element (OPE) mounted to a control rod (i.e. playing piece). The second element is a Propelled Object Blocking Element (POBE) that is attached to a jacketed cable movement devise (i.e. goaltender). The third element is a Suspended Playing Surface Element (SPSE), which is comprised of a hinged, substantially square structure with a raised border having a goal cavity at each end overlaying a smooth layered playing surface (i.e. game table). In this embodiment the game is illustrated having six playing pieces, three per side, and two goaltenders, one per side, with one playing object. In this embodiment a solid disc-shaped playing object (i.e. hockey puck) is shown, however, a variety of playing objects may be used to simulate games other then hockey such as a ball for soccer, field hockey etc.

Figure 1:
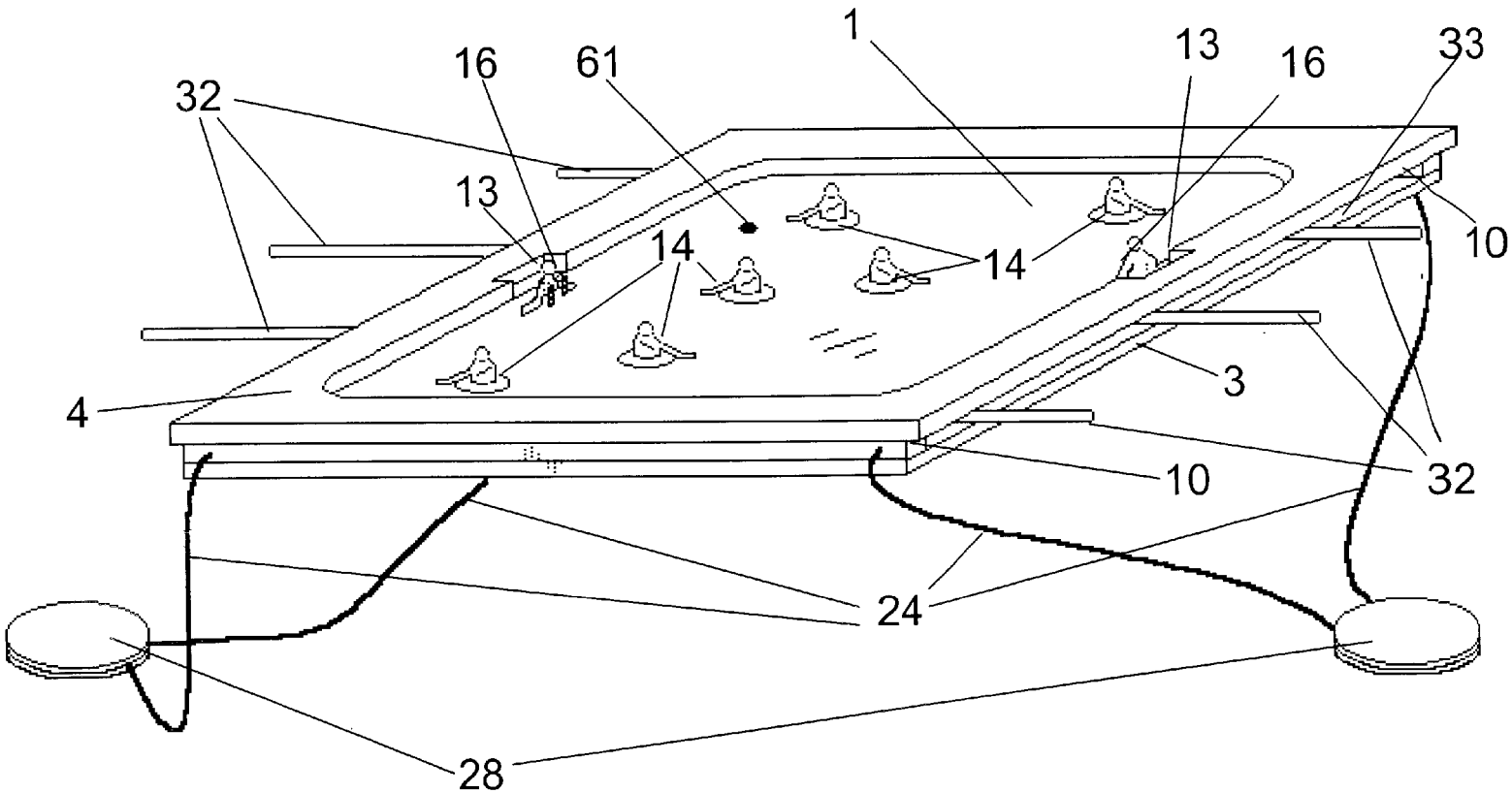
FIG. 1 shows a perspective view of the game, in accordance with certain preferred embodiments of the present invention.

FIG. 1 shows a perspective view of the game illustrating the playing surface 1 where the OPE's upper component assembly 14, the POBE's upper component assembly 16 and the playing object 61 slide. Six OPE upper component assemblies 14, three per side, and two POBE upper component assemblies 16, one per side, located in front of each goal cavity 13 and one playing object 61 are displayed on the playing surface 1. A raised border 4 that defines the playing surface having a goal cavity 13 located at each end is also exhibited. The goal cavities 13 are designed so that the playing object 61 drops off the playing surface 1 when a goal is scored. Also shown are frame sides 10 that suspend the playing surface 1 above the playing surface base 3 to create a space in which the lower component assembly of the OPE's slide while providing control rod openings 33 at each end of the SPSE that allow the control rods 32 to extend outwardly. The control rods 32 are not fixed to the SPSE and can move in and out and from side to side without restriction in a plane that is substantially parallel to the playing surface base 3.

Four jacketed cables 24 that are attached to the POBE's rotating foot mechanisms 28 are exhibited exiting the SPSE. In this embodiment the rotating foot mechanisms 28 may be placed on the floor while the SPSE may be placed on a table or permanent pedestal (not shown).

Figure 2:
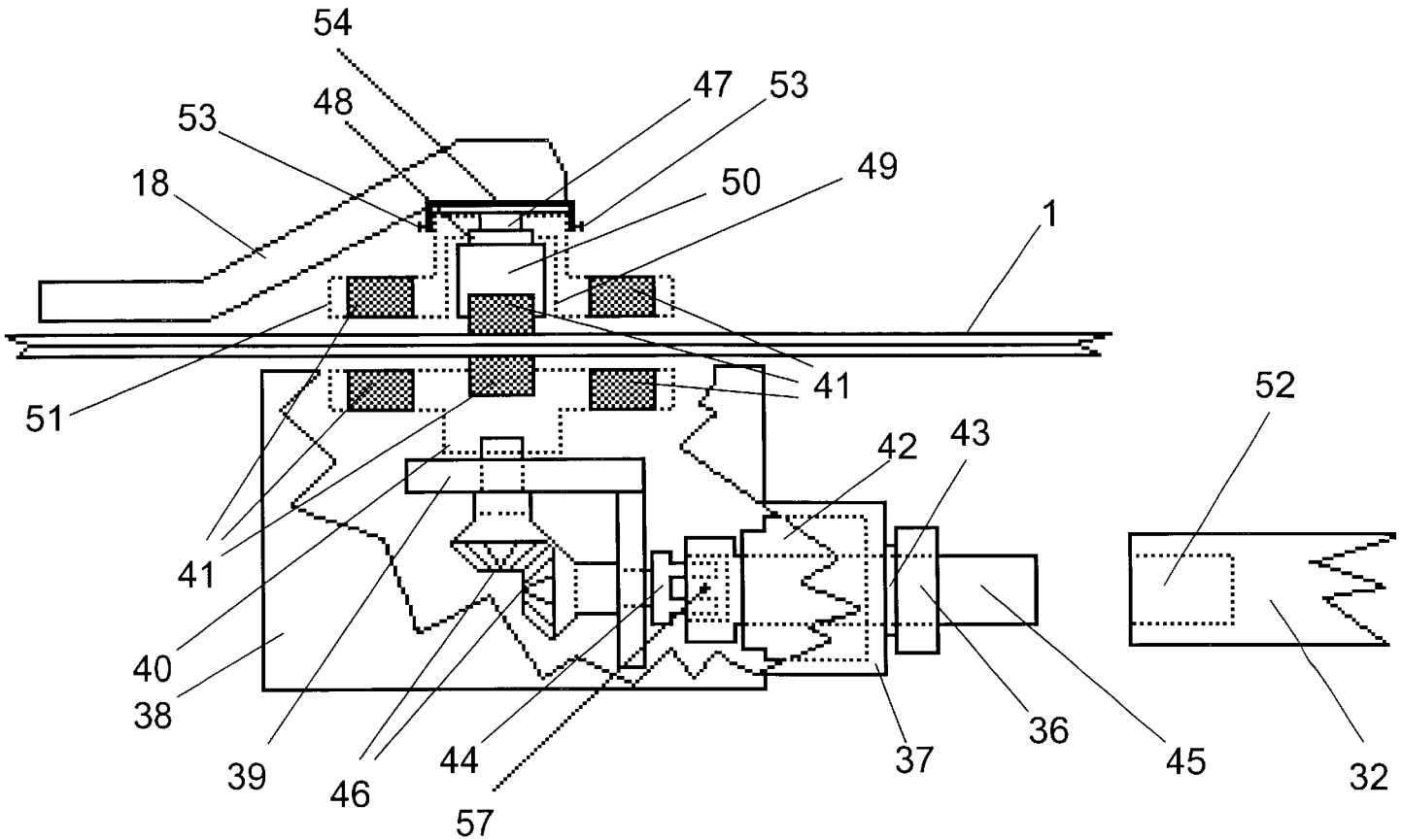
FIG. 2 shows a partial cross-sectional side view of the upper and lower components of the Object Propelling Element (OPE) engaged with the playing surface.

FIG. 2 shows a cross-sectional side view bisecting the OPE's upper magnet rotor 51 and the lower magnet rotor actuator 40 to illustrate their interior components as they engage the playing surface 1. A portion of the OPE's impact ring 38 and the impact stud bearing brace 37 are cutaway to exhibit all the drive mechanism components and their positioning.

The OPE's upper component assembly is comprised of an upper magnet rotor 51 that is a two-dimensional round structure. The larger diameter portion has a round flat base having a thickness sufficient enough to accept two similarly polled permanent magnets 41 that are implanted diametrically opposite one another within its periphery.

The larger diameter portion transitions to a smaller diameter portion. Centrally located within the smaller diameter portion of the upper magnet rotor 51 is a bushing cavity 49 that has a rotation bushing 48 in the center of the cavity end, designed to accept a rotation stud 47. The rotation stud 47 extends upwardly and is fixed to the center of a cylindrical magnet housing 50 that has a permanent magnet 41 implanted within its base protruding downwardly. This permanent magnet 41 is configured to have the opposite polarity of the permanent magnets 41 located peripherally within the upper magnet rotor's 51 base. The rotation stud 47, which is attached to the magnet housing 50, is inserted into the rotation bushing 48. The magnet housing 50 is designed to fit loosely within the bushing cavity 49. In this configuration the upper magnet rotor 51 freely rotates on the magnet housing 50, elevated above the playing surface 1.

A striking arm/figure mount 18 that is comprised of a thin high impact plastic is centered over and attached perpendicularly to a round base. The striking arm portion extends beyond the perimeter of the round base angling downwardly to a point where it becomes horizontal to the base, and in this embodiment is fashioned to simulate a hockey type stick. As illustrated, when the striking arm/figure mount 18 is mounted to the upper magnet rotor 51, the bottom of the striking arm portion is horizontal to the base and is slightly elevated from the playing surface 1. A side, end and bottom view of the striking arm/figure mount 18 is also shown in FIGS. 10, 11 and 12 respectively.

The base of the striking arm/figure mount 18 is centered over the top of the smaller diameter portion of the upper magnet rotor 51 and is attached via an elastic mounting band 54. The elastic mounting band 54 is secured around one of two mounting pins 53 that are fixed, diametrically opposite one another, to the side of the smaller diameter portion of the upper magnet rotor 51. The elastic mounting band 54 is stretched over the top of the base of the striking arm/figure mount 18 on both sides of the striking arm and is secured to the mounting pin 53 located on the opposite side of the upper magnet rotor 51.

Utilizing this mounting system, a limited counter rotation of the striking arm/figure mount 18 occurs when the upper magnet rotor 51 is rotated to strike the playing object causing the elastic mounting band 54 to stretch. This creates additional forward striking momentum by transferring the energy created when the stretched elastic reconfigures to the striking arm/figure mount 18 in turn increasing the velocity of the playing object when struck. A bottom, top, front and side view of the striking arm/figure mount 18 installed is also displayed in FIGS. 6, 7, 8 and 9 respectively.

Figure 11:
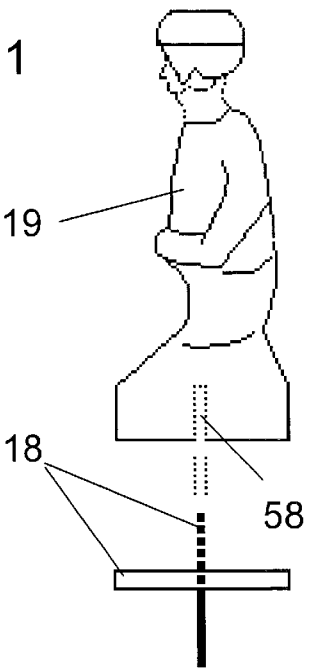
FIGS. 10 and 11 show a front and side view of the Object Propelling Element's (OPE) striking arm/figure mount with exploded views of a hockey player figurine.
Figure 10:
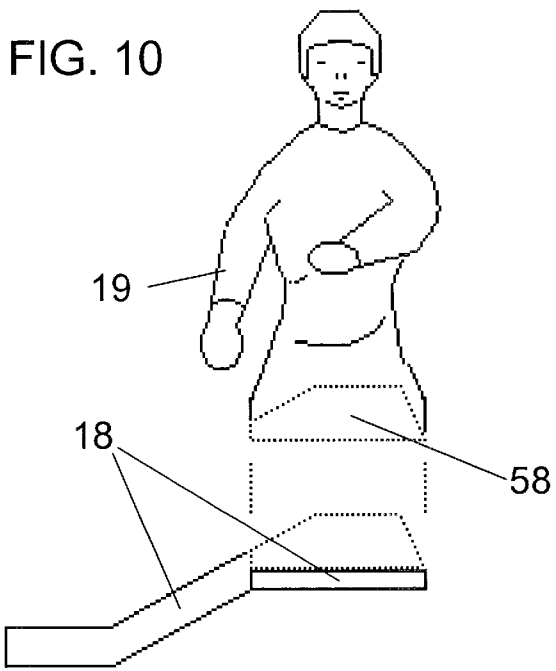
Figure 12:
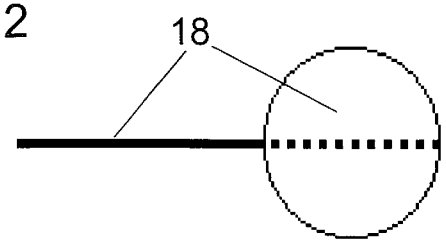
FIG. 12 shows a bottom view of the Object Propelling Element's (OPE) striking arm/figure mount.

The portion of the striking arm/figure mount 18 that extends upward above the top of the upper magnet rotor 51 is designed to accept a lightweight molded figurine 19 (i.e. hockey player) displayed in FIGS. 10 and 11. A side, end and bottom view of the striking arm/figure mount 18 is also displayed in FIGS. 10, 11 and 12 respectively.

The OPE's lower component assembly is comprised of a lower magnet rotor actuator 40 that is a two-dimensional round structure. The larger diameter portion has a round flat top surface having a thickness sufficient enough to accept two permanent magnets 41 implanted diametrically opposite one another within its periphery. These permanent magnets 41 are positioned to mirror and are polled to attract to the upper magnet rotor 51 magnets. Implanted and protruding upwardly in the center of this rotor is a permanent magnet 41 that mirrors and is polled to attract to the permanent magnet 41 within the magnet housing 50 in the upper magnet rotor 51. This centrally located permanent magnet 41 is positioned as to create a space between the top of the lower magnet rotor actuator 40 and the bottom of the playing surface 1.

The larger diameter portion of the lower magnet rotor actuator 40 transitions to a smaller diameter portion. The smaller diameter portion 40 is attached to the shaft of a vertically mounted miter gear located within a miter gear assembly 46. This assembly is illustrated mounted to a gear assembly bracket 39. The gear assembly bracket 39 is also exhibited as a side, top and bottom view in FIGS. 3, 4 and 5 respectively. The gear assembly bracket 39 is mounted to an impact ring 38.

The impact ring 38 is a cylindrical tube made of high impact plastic that in addition to mounting the gear assembly bracket 39 aids in dispersing all impact shock that may occur with the SPSE framing assembly to protect the gear assembly components mounted within.

Figure 3:
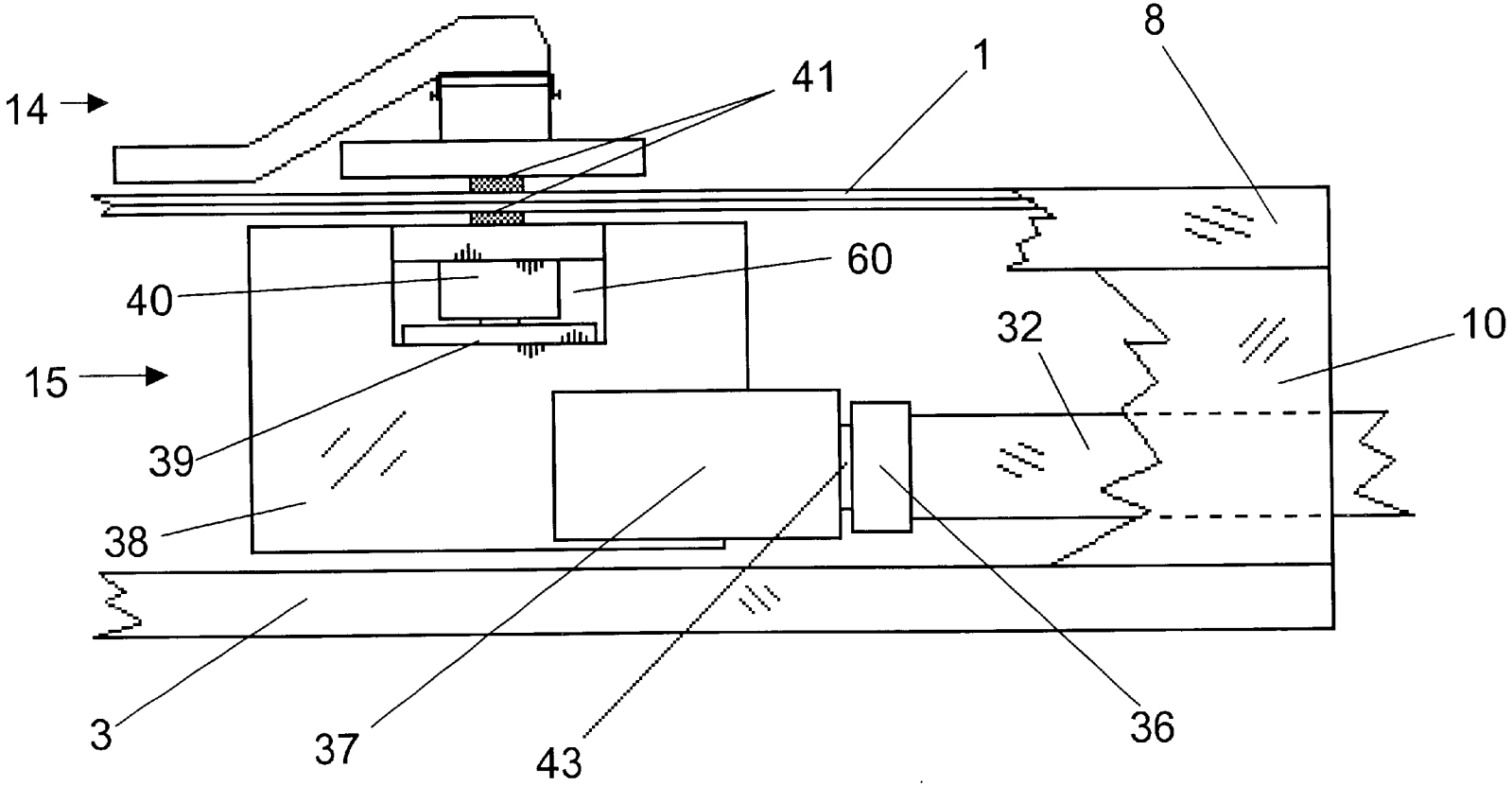
FIG. 3 shows a side view of an Object Propelling Element (OPE) positioned within the Suspended Playing Surface Element (SPSE) and engaged with the playing surface.

An impact ring gear assembly slot 60, exhibited in FIG. 3, is cut into the impact ring 38 to create a mounting base that is in a plane substantially parallel to the top and bottom of the impact ring 38. The gear assembly bracket 39 is mounted to the base of the impact ring gear assembly slot 60 as illustrated in FIG. 3. An additional top and bottom view of the gear assembly brackets 39 positioning is displayed in FIGS. 4 and 5 respectively. The impact ring gear assembly slot 60 is of sufficient depth and dimension to insure that the top of the lower magnet rotor actuator 40 is on the same plane as the top of the impact ring 38.

As illustrated, when magnetically coupled the permanent magnets 41 located in the center of the lower magnet rotor actuator 40 and in the magnet housing 50 of the upper magnet rotor 51, are the only two points contacting the playing surface 1, and are the primary coupling magnets. In addition to providing the rotation capability for the upper magnet rotor 51, the magnets implanted peripherally in both rotors also couple, and because of their polarity configuration and positioning increase the magnetic flux density of the centrally located magnets. This coupling system was designed to reduce friction with the playing surface 1 while increasing coupling strength, allowing the playing pieces to be easily moved about the playing surface without detaching. Utilizing this coupling configuration, the peripherally mounted magnets do not contact the playing surface 1 allowing the lower magnet rotor actuator 40 and the upper magnet rotor 51 to rotate with minimal friction. The peripherally implanted magnets within the rotors also have the ability to uncouple and rotate 180 degrees to magnetically reattach if they are rotated rapidly or come in contact with an opposing playing piece, without causing the upper magnet rotor 51 to detach from the playing surface 1.

The assembly that drives the OPE is comprised of an impact stud bearing 42, an impact stud bearing brace 37 and a gear coupling shaft bearing 43 that are aligned to the shaft of the horizontally mounted miter gear within the miter gear assembly 46 and are attached to the impact ring 38. Additional side, top and bottom views of this assembly mounted to the impact ring 38 are displayed in FIGS. 3, 4 and 5 respectively. This assembly provides, in addition to drive component protection, a mounting assembly for a gear assembly drive coupling shaft 45.

The gear assembly drive coupling shaft 45 is a two-dimensional round shaft having a larger diameter portion that transitions to a smaller diameter portion. The smaller diameter portion of the shaft passes through the impact stud bearing 42, the impact stud bearing brace 37, the gear coupling shaft bearing 43 and is secured to this assembly with a drive coupling impact collar 36 in a fashion as to allow the gear assembly drive coupling shaft 45 to rotate freely within the assembly with minimal linear movement. In this configuration the center of the gear assembly drive coupling shaft 45 is aligned with the center of the shaft of the horizontally mounted miter gear of the miter gear assembly 46.

A portion of the smaller diameter shaft of the gear assembly drive coupling shaft 45 extends beyond the drive coupling impact collar 36 and is inserted and secured within the control rod connecting cavity 52 of the control rod 32.

The larger diameter portion of the gear assembly drive coupling shaft 45 has a round hole centrally located and extending into the end of the shaft forming a cavity. A gear assembly rotation pin 57 is secured perpendicularly through the shaft bisecting the cavity. This cavity has an inside diameter slightly larger than the outside diameter of a gear assembly coupling 44 that fits loosely within.

The gear assembly coupling 44 is a two-dimensional round shaft. The larger diameter portion of the shaft connects to the horizontally positioned miter gear shaft of the miter gear assembly 46. This shaft transitions to a smaller diameter shaft that is slotted to receive the gear assembly rotation pin 57 that is located within the gear assembly drive coupling shaft 45 cavity. This slot is designed to allow the gear assembly rotation pin 57 to slide linearly within the slot.

When assembled, there is a gap between the end of the slotted shaft of the gear assembly coupling 44 and the cavity bottom within the gear assembly drive coupling shaft 45. There is also a gap between the gear assembly rotation pin 57 and the bottom of the slot in the gear assembly coupling 44. These gaps prevent damage to the miter gear assembly 46 due to linear movement and/or impact to the OPE.

FIG. 3 shows a side view of the previously described OPE in engagement with the playing surface 1 with a portion of one side of the SPSE cutaway to exhibit its positioning within. This view also shows the playing surface 1 suspended in a substantially parallel plane over a playing surface base 3 by a securing angle 8 attached to a frame side 10 forming a space that accepts the lower component assembly 15. The lower component assembly 15 is loosely sandwiched within the space extending between the playing surface base 3 and the playing surface 1. The bottom of the lower component assembly's 15 impact ring 38 may slide on the playing surface base 3 when separated from the upper component assembly 14 and may be magnetically reattached by sliding the lower component assembly 15 under the upper component assembly 14. As illustrated, when the lower component assembly 15 is magnetically coupled to the upper component assembly 14 it becomes suspended over the playing surface base 3. The SPSE assembly will be described in detail.

Also shown are views of the previously described lower magnet rotor actuator 40, primary coupling permanent magnets 41, gear assembly bracket 39, impact ring gear assembly slot 60, impact stud bearing brace 37, gear coupling shaft bearing 43, drive coupling impact collar 36 and the control rod 32.

Figure 4:
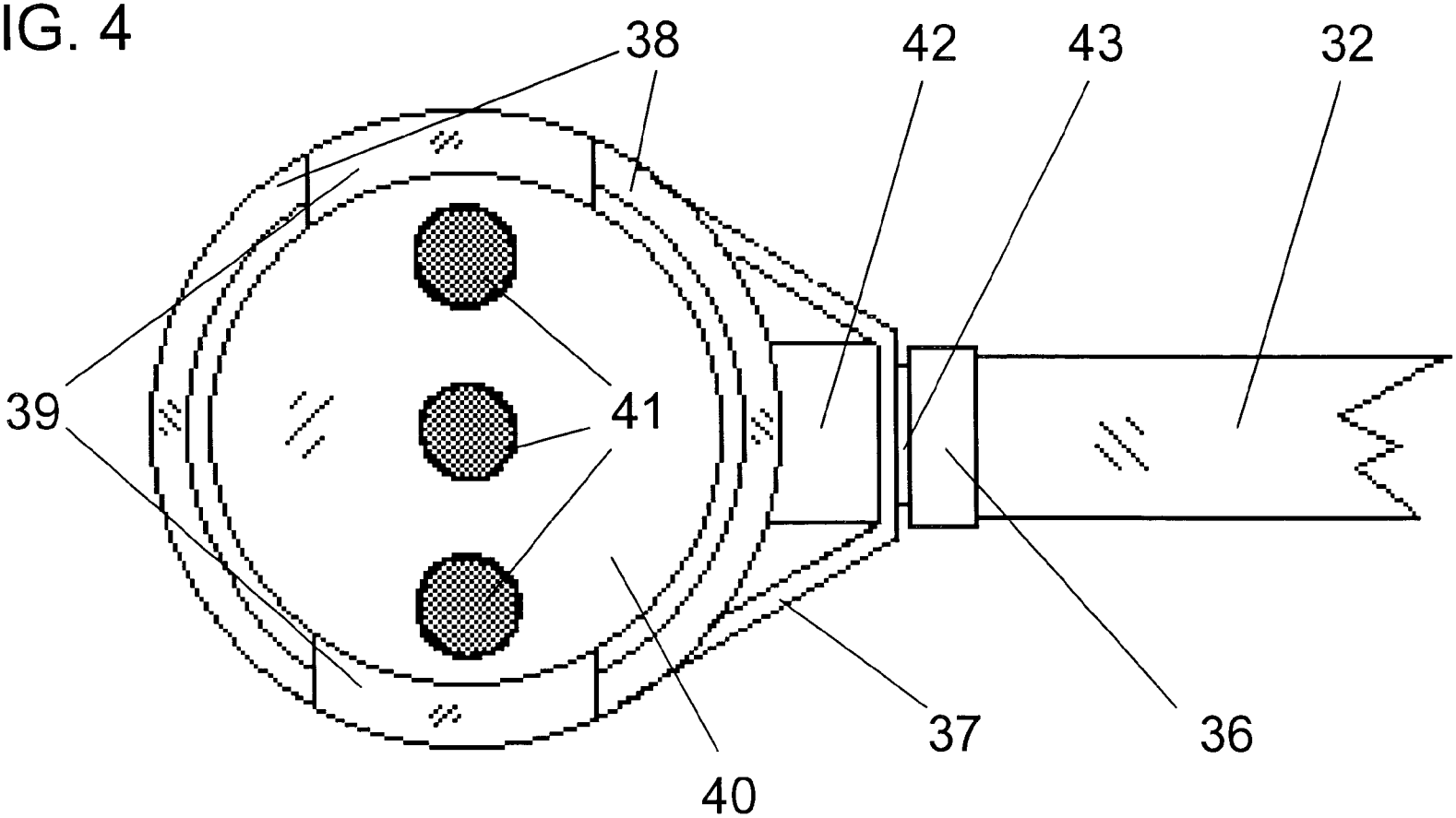
FIGS. 4 and 5 show respective top and bottom views of the lower component assembly of the Object Propelling Element (OPE)

FIG. 4 shows a top view of the previously described OPE's lower component assembly exhibiting the impact ring 38 and the positioning of the gear assembly bracket 39, the lower magnet rotor actuator 40 with the permanent magnets 41 implanted, the impact stud bearing 42, the impact stud bearing brace 37, the gear coupling shaft bearing 43, the drive coupling impact collar 36 and the control rod 32.

Figure 5:
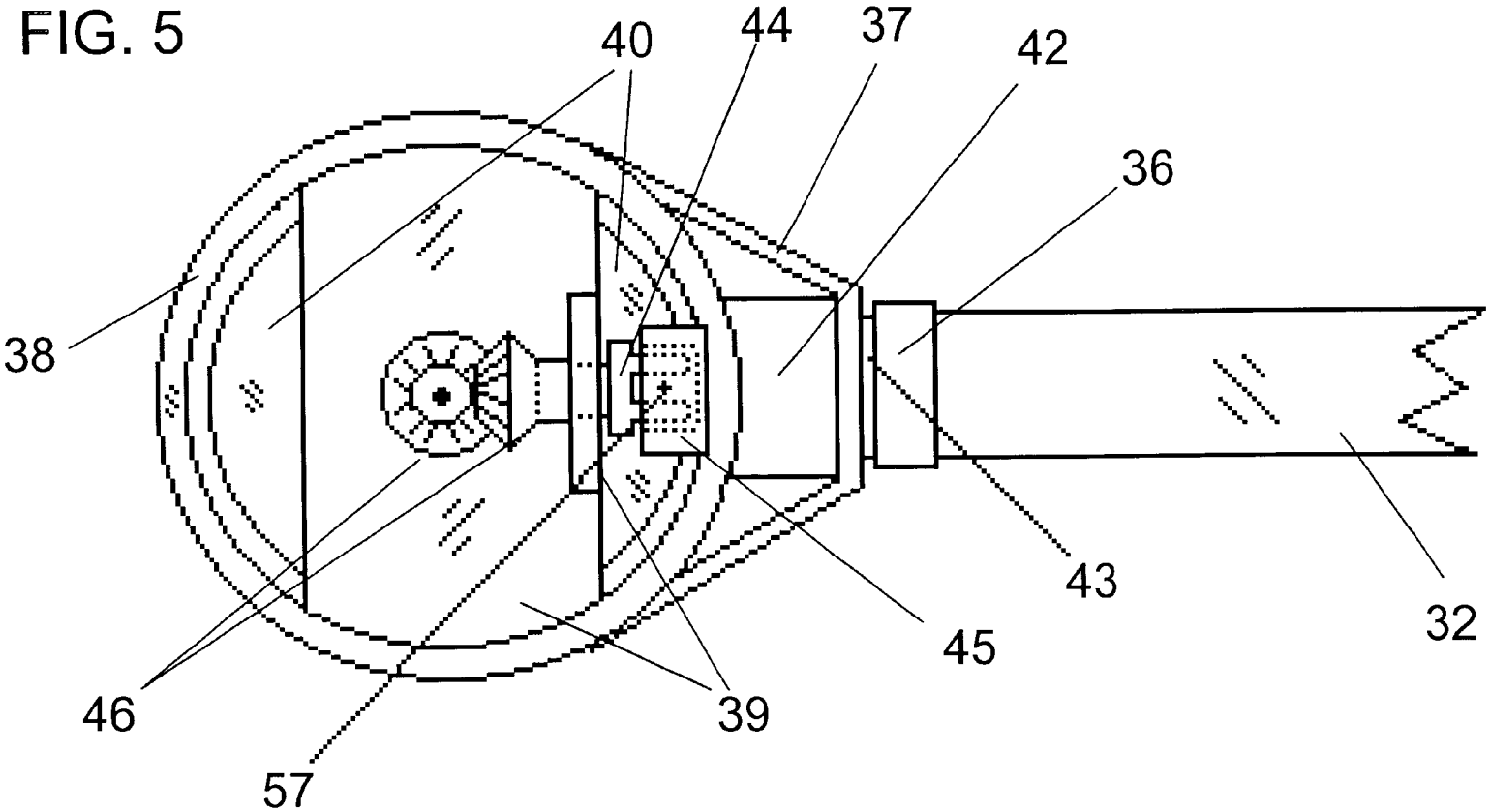

FIG. 5 shows a bottom view of the previously described OPE's lower component assembly exhibiting the impact ring 38 and the positioning of the lower magnet rotor actuator 40, the gear assembly bracket 39, the miter gear assembly 46, the gear assembly coupling 44, the gear assembly drive coupling shaft 45, the gear assembly rotation pin 57, the impact stud bearing 42, the impact stud bearing brace 37, the gear coupling shaft bearing 43, the drive coupling impact collar 36 and the control rod 32.

Figure 6:
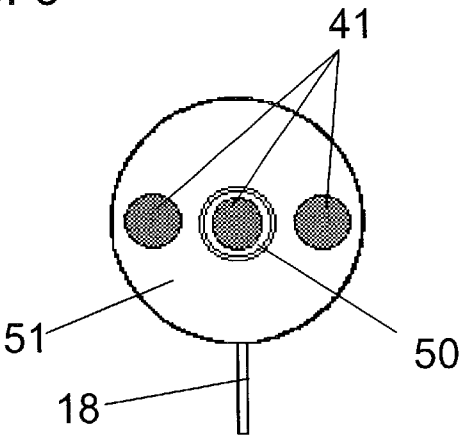

FIG. 6 shows a bottom view of the previously described OPE's upper component assembly exhibiting the upper magnet rotor 51 with the striking arm/figure mount 18 installed. The positioning of the permanent magnets 41 peripherally implanted within the upper magnet rotor 51 and the centrally located permanent magnet 41 implanted within the magnet housing 50 are also illustrated.

Figure 7:
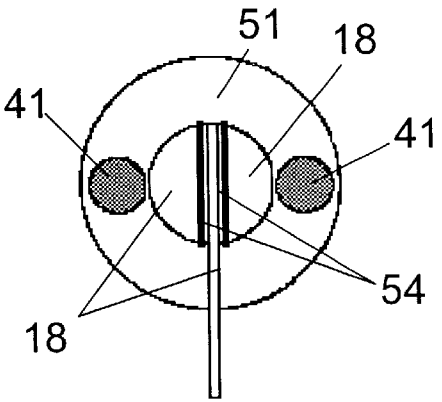
FIGS. 6–9 show respective bottom, top, front and side views of the upper component assemblies Object Propelling Element (OPE)

FIG. 7 shows a top view of the previously described OPE's upper component assembly exhibiting the upper magnet rotor 51 with the striking arm/figure mount 18 installed. The positioning of the elastic mounting band 54 and the peripherally implanted permanent magnets 41 are also illustrated.

Figure 8:
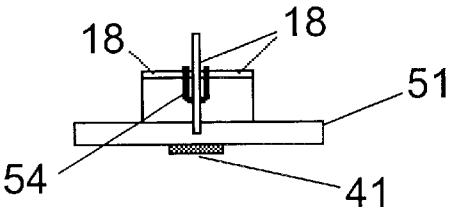

FIG. 8 shows a front view of the previously described OPE's upper component assembly exhibiting the upper magnet rotor 51 with the striking arm/figure mount 18 installed. The positioning of the elastic mounting band 54 is also displayed. This view also illustrates the centrally located permanent magnet 41 that extends downward to elevate the upper magnet rotor 51 from the playing surface.

Figure 9:
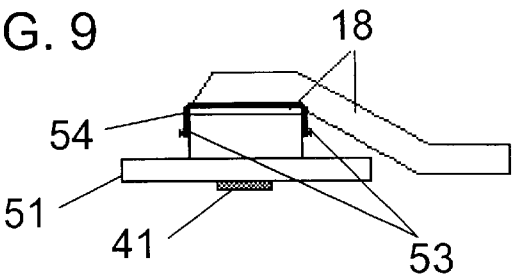

FIG. 9 shows a side view of the previously described OPE's upper component assembly exhibiting the upper magnet rotor 51 with the striking arm/figure mount 18 installed. The positioning of the elastic mounting band 54 secured around the two mounting pins 53 is also displayed. This view also illustrates the centrally located permanent magnet 41 that extends downward to elevate the upper magnet rotor 51 from the playing surface.

FIG. 10 shows a side view and FIG. 11 shows an end view of the previously described striking arm/figure mount 18 with exploded views of a molded figurine 19 with its mounting slot 58 positioned directly above the mounting portion of the striking arm/figure mount 18. The figure mounting portion of the striking arm/figure mount 18 and the mounting slot 58 within the molded figurine 19 are defined with broken lines, exhibited in FIGS. 10, 11 and 12. The molded figurine 19 is made of a light weight molded plastic and has a flat round base that has the same diameter as the striking arm/figure mount base 18, exhibited in FIG. 12 as a bottom view. The bottom of the molded figurine 19 has a mounting slot 58, displayed in FIG. 10 as a front view and in FIG. 11 as a side view, that mates with the mounting portion of the striking arm/figure mount 18. The mounting slot 58 is of sufficient width as to create a friction coupling when mated. With this design the molded figurine 19 can easily be removed or replaced without removing the striking arm/figure mount 18.

FIG. 12 is a bottom view of the previously described striking arm/figure mount 18.

In the prefered embodiment, the Object Propelling Element (OPE) operates as follows: As displayed in FIG. 3, the upper component assembly 14 is magnetically coupled to the lower component assembly 15 through the playing surface 1 to form a unitary structure. The lower component assembly 15 elevates from the playing surface base 3. The control rod 32, of the lower component assembly 15, which extends in an unfixed configuration beyond the end of the Suspended Playing Surface Element (SPSE) may be pushed, pulled or moved from side to side in turn moving the upper component assembly 14 over the playing surface 1. The control rod 32 of the lower component assembly 15 may also be rotated in both directions vertically, which rotates the miter gear assembly 46 when the gear assembly rotation pin 57 engages the interior surface of the slot in the gear assembly coupling 44 exhibited in FIGS. 2 and 5. This vertical rotation now becomes horizontal and rotates the lower magnet rotor actuator 40, which in turn rotates the upper magnet rotor 51 and striking arm/figure mount 18, exhibited in FIG. 2. The upper component assembly 14 can be moved in all directions over the playing surface 1 and rotated to propel a playing object.

Figure 13:
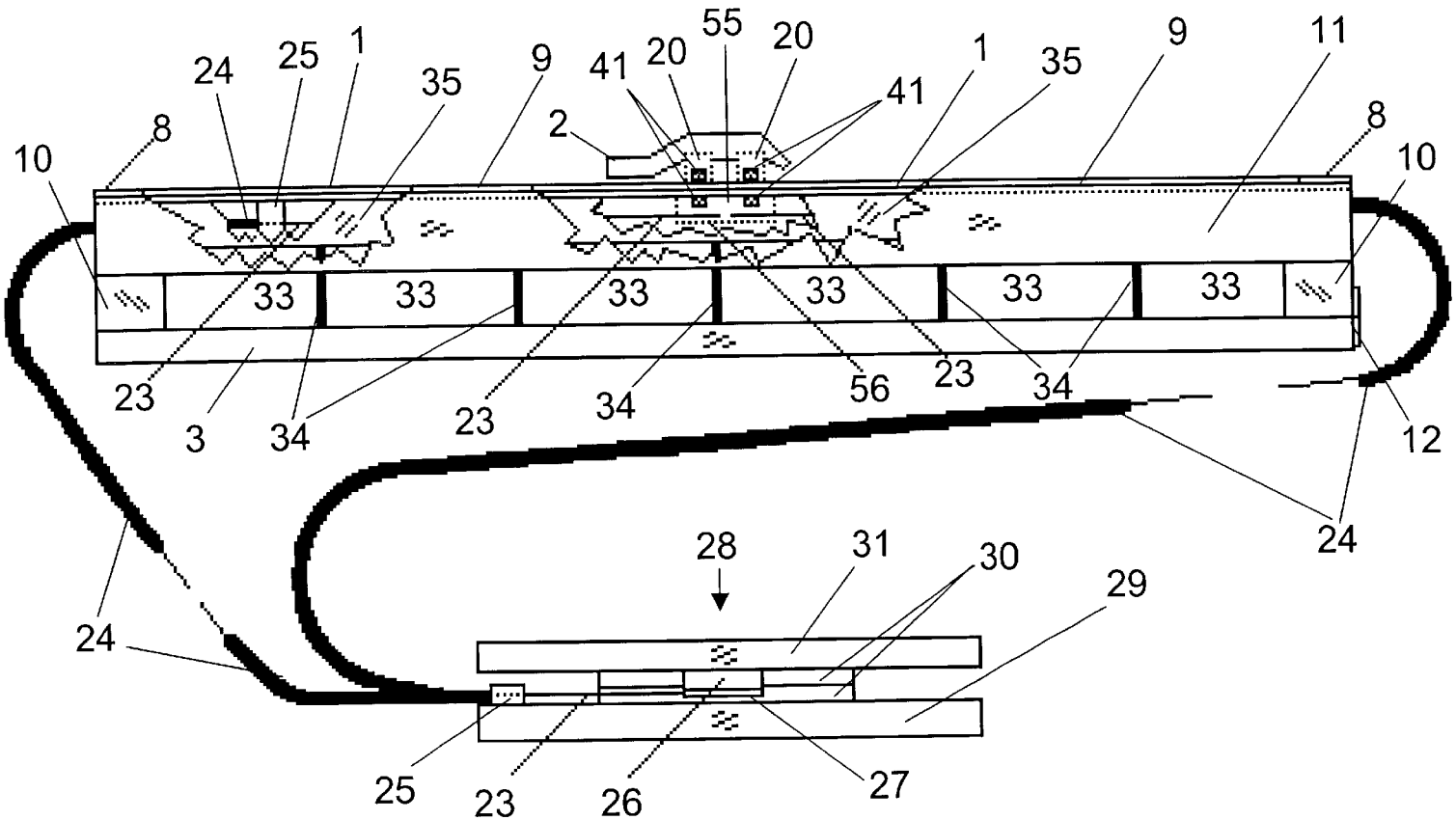
FIG. 13 shows a partial cross-sectional view of the Propelled Object Blocking Element's (POBE) assembly.

FIG. 13 shows an end view of the Propelled Object Blocking Element (POBE) engaged with the playing surface 1. Also illustrated are two views, at one end and centrally located, showing the Suspended Playing Surface Element (SPSE) cutaway to exhibit one side of the lower component assembly's positioning within. A side view of a rotating foot mechanism 28 connected to a cable plus jacketing 24 is also exhibited.

The POBE is a magnetically mated device having upper and lower component assemblies. The two components are capable of being separated from one another and then magnetically reattached. When magnetically coupled through the playing surface 1, they may slide from side to side by cables linked to a rotating foot mechanism 28.

The upper component assembly is comprised of two tubular legs 20 that have permanent magnets 41 implanted within their base. A blocking arm/figure mount 2 made of a thin high impact plastic, fashioned to simulate a goal tender type stick, is fixed to the top of two tubular legs 20 and extends to one side in a direction substantially perpendicular to the playing surface 1. A portion of the striking arm/figure mount 2 extends upward and is designed to accept a light weight plastic molded figurine 21 (i.e. goal tender) exhibited as a front and side view in FIG. 19 and 20 respectively. The tubular legs 20 are of sufficient length so that the blocking arm/figure mount 2 is elevated from the playing surface 1. A sectional view bisecting the two tubular legs 20 to exhibit the permanent magnets 41 positioning is also illustrated.

The lower component assembly is comprised of a magnet housing actuator 55 that has two permanent magnets 41 implanted within, mirroring and polled to attract to the permanent magnets 41 implanted within the two tubular legs.

Two cables 23 are secured to each end of the magnet housing actuator 55 with a magnet housing mooring plate 56. A sectional view bisecting the magnet housing actuator 55 and the magnet housing cable mooring plate 56, to exhibit the permanent magnets 41 and cable positioning, is also illustrated. The two cables 23 travel through a framing channel 35 toward cable jacketing mooring studs 25 that are secured within the framing channel 35, at each end.

The framing channel 35 serves a dual purpose, in addition to being part of the Suspended Playing Surface Element (SPSE) it also provides a housing for the POBE's lower component assembly's magnet housing actuator 55, cables 23, cable jacketing mooring studs 25 and the cables plus jacketing 24. The top of the framing channel 35 also has a framing channel opening 22 cut into it that allows the top of the magnet housing actuator 55 to contact the bottom of the playing surface 1. The framing channel opening 22 is of sufficient length and width to accommodate the side-to-side movement of the magnet housing actuator 55, and is located in front of the goal cavity 13. The framing channel opening 22 is exhibited as top view in FIGS. 14, 24, 25 and 26.

Each cable travels through a jacket that is attached to a cable jacketing mooring stud 25 located at, and secured within the framing channel 35. Additional larger scale top, end and side views of this assembly are displayed in FIGS. 14, 15, 16 and 17 respectively.

The cable plus jacketing 24 exits the sides of the SPSE through framing channel cable openings 59. A side view of two of the four framing channel cable openings 59 is exhibited in FIG. 23.

The cable plus jacketing 24 is attached to a rotating foot mechanism 28 and is of sufficient length and flexibility to allow the rotating foot mechanism 28 to be placed preferably on the floor, in a variety of positions, at the ends of the game table. This allows the game operator to situate the rotating foot mechanism 28 in a comfortable position for game play. A view of the cables plus jacketing 24 exiting the SPSE, and attached to the rotating foot mechanism 28 at each end of the game is exhibited in FIG. 1.

The ends of the cable plus jacketing 24, exiting the SPSE, are attached to two cable jacketing mooring studs 25. The cable jacketing mooring studs 25 are attached in a fixed position to a rotating foot mechanism base 29. The rotating foot mechanism base 29 is a round flat structurally sound plate having a thickness sufficient enough as to provide a mounting structure for its assembly components. The two cables 23 within the cable plus jacketing 24 exit the cable jacketing mooring studs 25 and are attached to the ends of a cable pulling arm 26 with cable mooring plates 27. The cables 23 are of sufficient length to insure that, when assembled, the cable pulling arm 26 is in a position so that there is an equal distance between the cable mooring plates 27 and the cable jacketing mooring studs 25, when the magnet housing actuator 55 is centered within the framing channel opening 22, displayed as a top view in FIG. 14.

Figure 18:
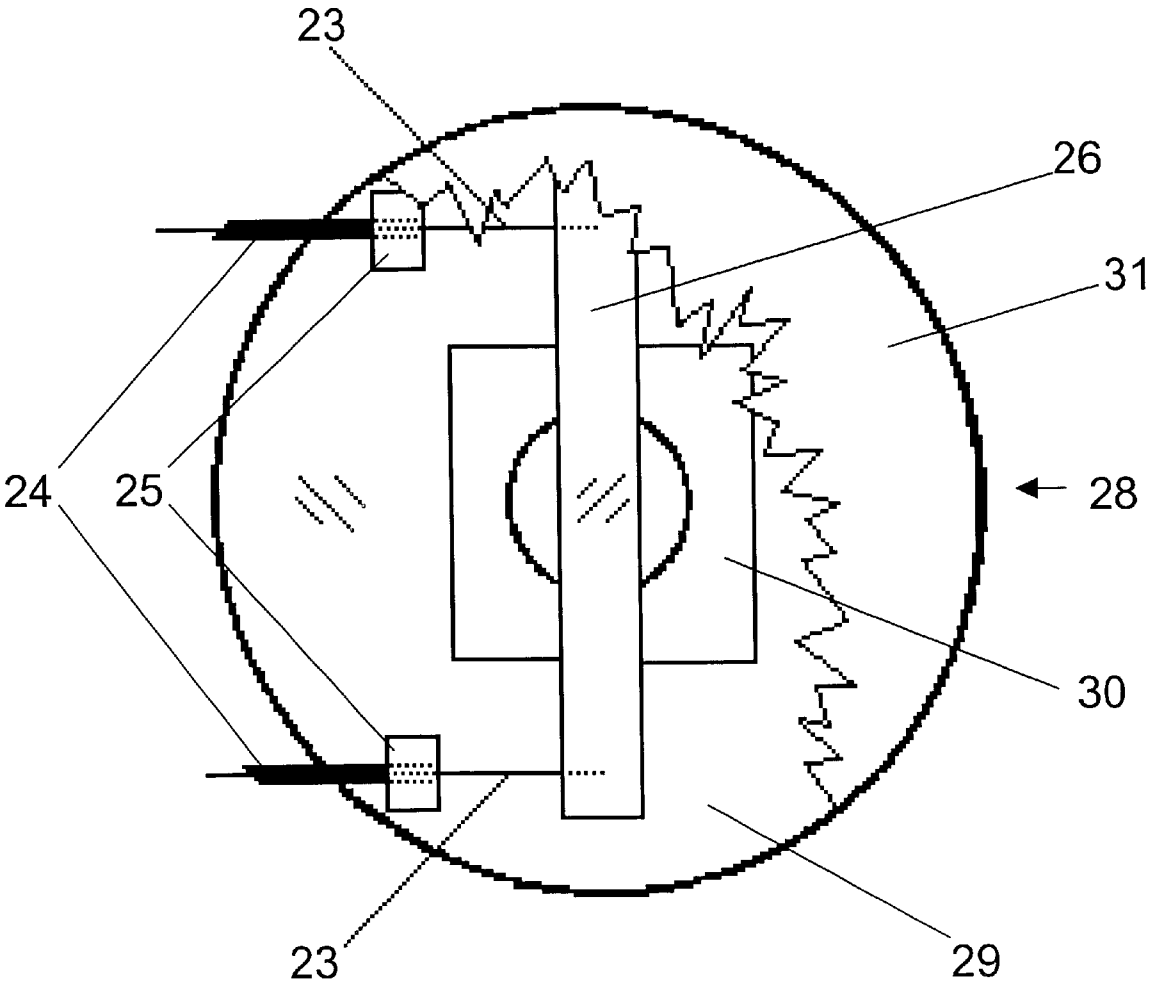
FIG. 18 shows a top cutaway view of the Propelled Object Blocking Element's (POBE) rotating foot mechanism.

The cable pulling arm 26 is centered over and is attached to swivel plates 30. The swivel plates 30 are centered and secured to the rotating foot mechanism base 29. Attached to the swivel plates 30 and the cable pulling arm 26 is a rotating footplate 31. The rotating footplate 31 is a round structurally sound flat plate having the same diameter as the rotating foot mechanism base 29, and a thickness sufficient enough as to allow it to be firmly attached. A top view of this assembly is also illustrated in FIG. 18.

Also exhibited, illustrating their positioning in relation to the POBE assembly, are views of the SPSE assemblies securing strip 9, securing angle 8, frame angle 11, frame sides 10, pivoting hinges 12, playing surface base 3, segments 34 and the control rod openings 33. The SPSE assembly will be described in detail.

Figure 14:
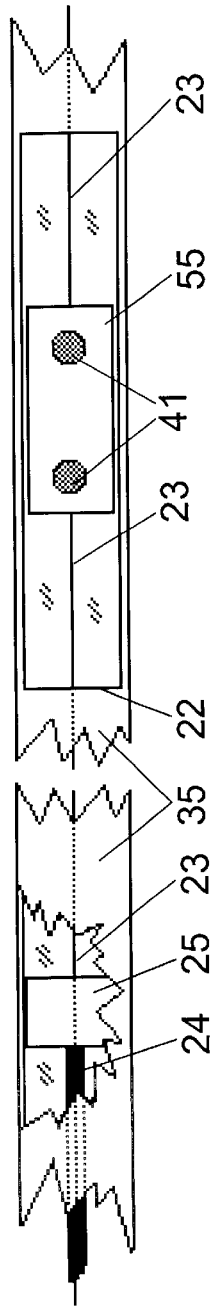

FIG. 14 shows two enlarged top view sections of the previously described framing channel 35 cutaway to exhibit the POBE assembly within. The first section shows the cable plus jacketing 24 mounted to the cable jacketing mooring stud 25 that is secured to the framing channel 35. The cable 23 that travels within the cable jacket is exhibited exiting the cable jacketing mooring stud 25 into the framing channel 35. The second section shows the two cables attached to the magnet housing actuator 55 with two permanent magnets 41 implanted. The positioning of the magnet housing actuator 55 within the channel opening 22 is also displayed.

Figure 15:
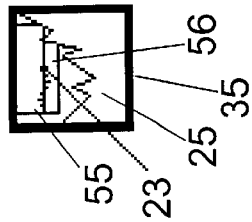
FIGS. 14–17 shows respective top, end and side partial cross sectional and cutaway views of the portion of the Propelled Object Blocking Element (POBE) assembly located within the Suspended Playing Surface Element (SPSE).

FIG. 15 is an end view of the previously described framing channel 35. This view shows a portion of the cable jacketing mooring stud 25 cutaway to exhibit the positioning of the magnet housing actuator 55 within the channel. The cable 23 mounted to the magnet housing cable mooring plate 56 is also displayed.

Figure 16:
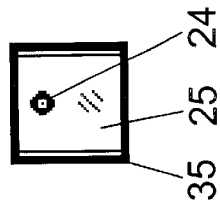

FIG. 16 shows an end view of the previously described framing channel 35 exhibiting the cable jacketing mooring stud 25 and the cable plus jacketing 24 mounted within.

Figure 17:
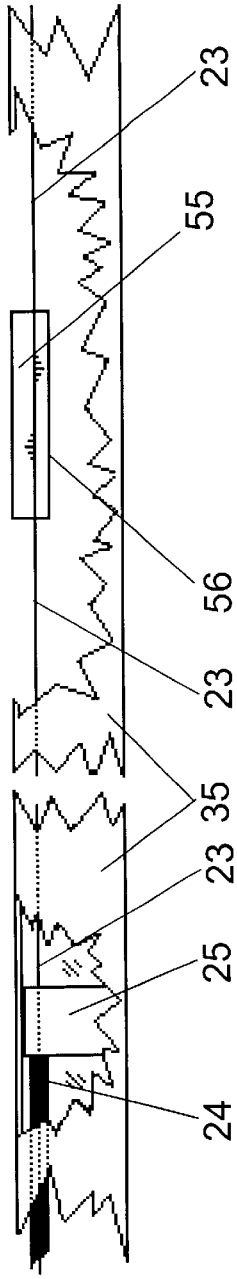

FIG. 17 shows two enlarged side view sections of the previously described framing channel 35 cutaway to exhibit the POBE assembly within. The first section shows the cable plus jacketing 24 mounted to the cable jacketing mooring stud 25 that is secured within the framing channel 35. The cable 23 that travels through the cable plus jacketing 24 is exhibited exiting the cable jacketing mooring stud 25 into the framing channel 35. The second section shows the two cables 23 attached to the magnet housing actuator 55 with the magnet housing cable mooring plate 56.

FIG. 18 shows a top view of the previously described rotating foot mechanism 28 with the rotating foot plate 31 cutaway to illustrate its component's positioning when assembled. The two cables plus jacketing 24 are displayed attached to the cable jacketing mooring studs 25 that are secured to the rotating foot mechanism base 29. The cable pulling arm 26 that is attached to the swivel plates 30 is exhibited mounted to the rotating foot mechanism base 29, with the two cables 23 attached.

Figure 20:
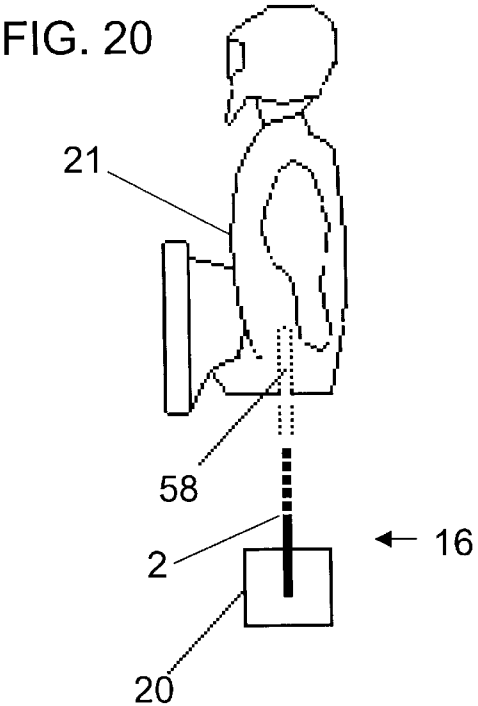
FIGS. 19 and 20 show front and side views of the Propelled Object Blocking Element's (POBE) upper component assembly with an exploded view of a hockey player figurine.
Figure 19:
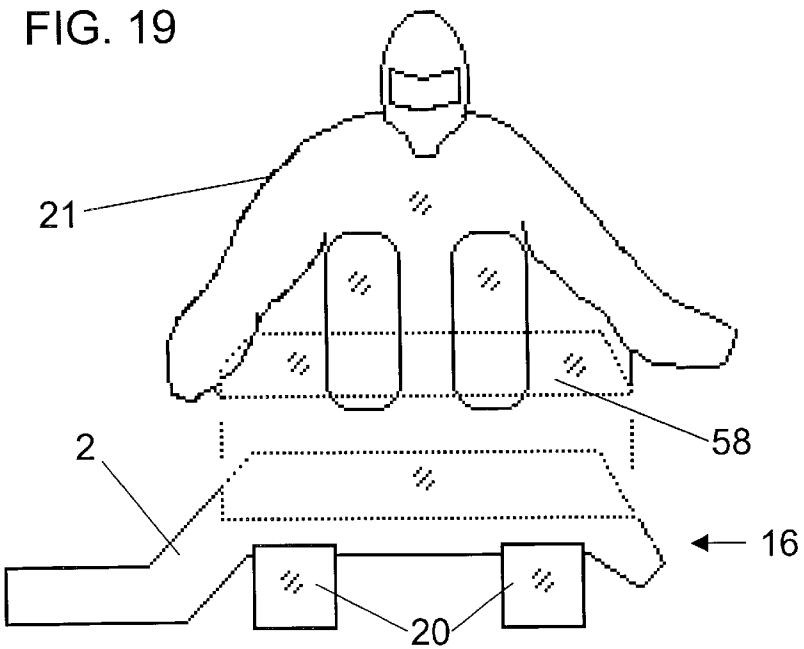

FIG. 19 shows a front view and FIG. 20 shows a side view of the previously described POBE's upper component assembly 16. These views show the positioning of the blocking arm/figure mount 2 when attached to the tubular legs 20, with exploded views of a molded figurine 21 (i.e. goal tender) positioned directly above the mounting portion of the blocking arm/figure mount 2. The figurine mounting portions of the blocking arm/figure mount 2 and mounting slots 58 located within the molded figurine 21 are defined with broken lines.

The molded figurine 21 is made of a lightweight molded plastic and has a substantially flat base. The base of the molded figurine 21 has a mounting slot 58, shown in FIG. 19 as a front view and FIG. 20 as a side view. The mounting slot 58 is of sufficient width as to create a friction coupling when mounted to the mounting portion of the blocking arm/figure mount 2. This assembly is designed to allow the molded figurine 21 to easily be removed or replaced without removing the blocking arm/figure mount assembly.

Figure 21:
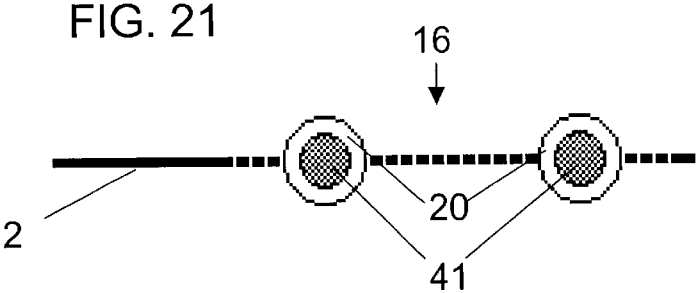
FIG. 21 shows a bottom view of the Propelled Object Blocking Element's (POBE) upper component assembly.

FIG. 21 is a bottom view of the previously described POBE's upper component assembly 16. This view shows the blocking arm/figure mount 2 attached to the two tubular legs 20, with the permanent magnets 41 implanted within their base. The portion of the blocking arm/figure mount 2 that accepts the hockey FIG. 21 is defined with a broken line.

In the preferred embodiment, the Propelled Object Blocking Element (POBE) operates as follows: The upper and lower component assemblies are magnetically coupled through the playing surface 1, displayed in FIG. 13. The rotating foot mechanism 28 is placed in a comfortable position preferably on the floor at the end of the game. In this embodiment two assemblies are illustrated one at each end of the game as displayed in FIG. 1. When the rotating foot plate 31, displayed in FIGS. 1, 13 and 18, is rotated in either direction it pulls the cable 23 that is attached to the cable pulling arm 26 through the fixed jacketing as the cable pulling arm 26 moves away from the cable jacketing mooring stud 25. This moves the lower component assembly's 17, displayed in FIGS. 24, 25 and 26, magnet housing actuator 55 within the confines of the channel opening 22, displayed in FIGS. 14, 24, 25 and 26, in the direction of the rotation. The POBE's magnetically coupled upper component 16, displayed in FIGS. 1 and 28, in turn moves from side to side over the playing surface 1 in the direction of the rotation.

Figure 22:
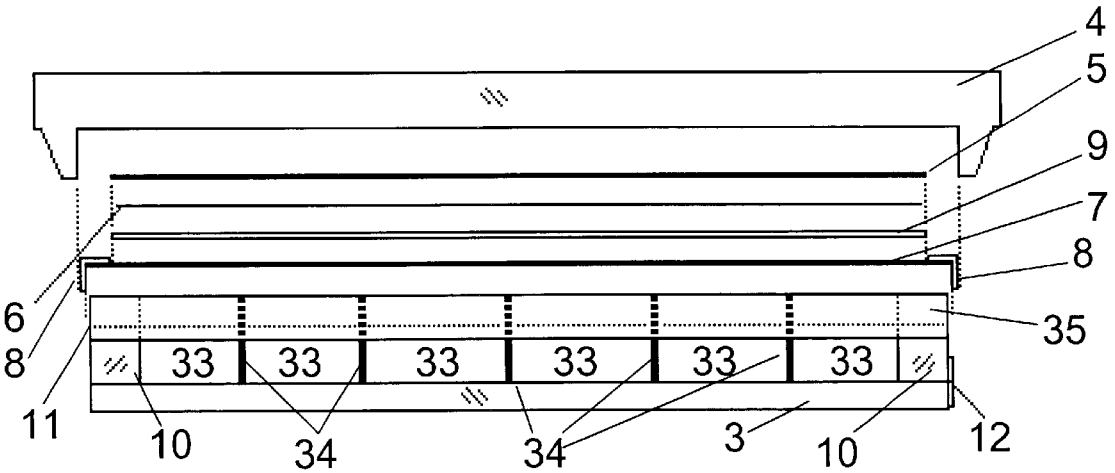
FIGS. 22 and 23 show respective partially exploded end and side views of the Suspended Playing Surface Element (SPSE).
Figure 23:
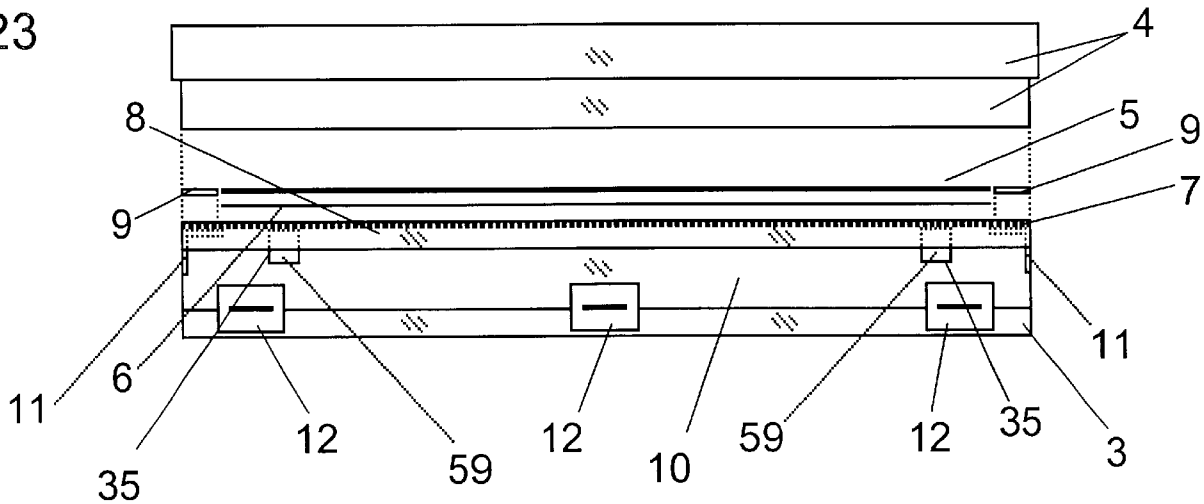
Figure 26:
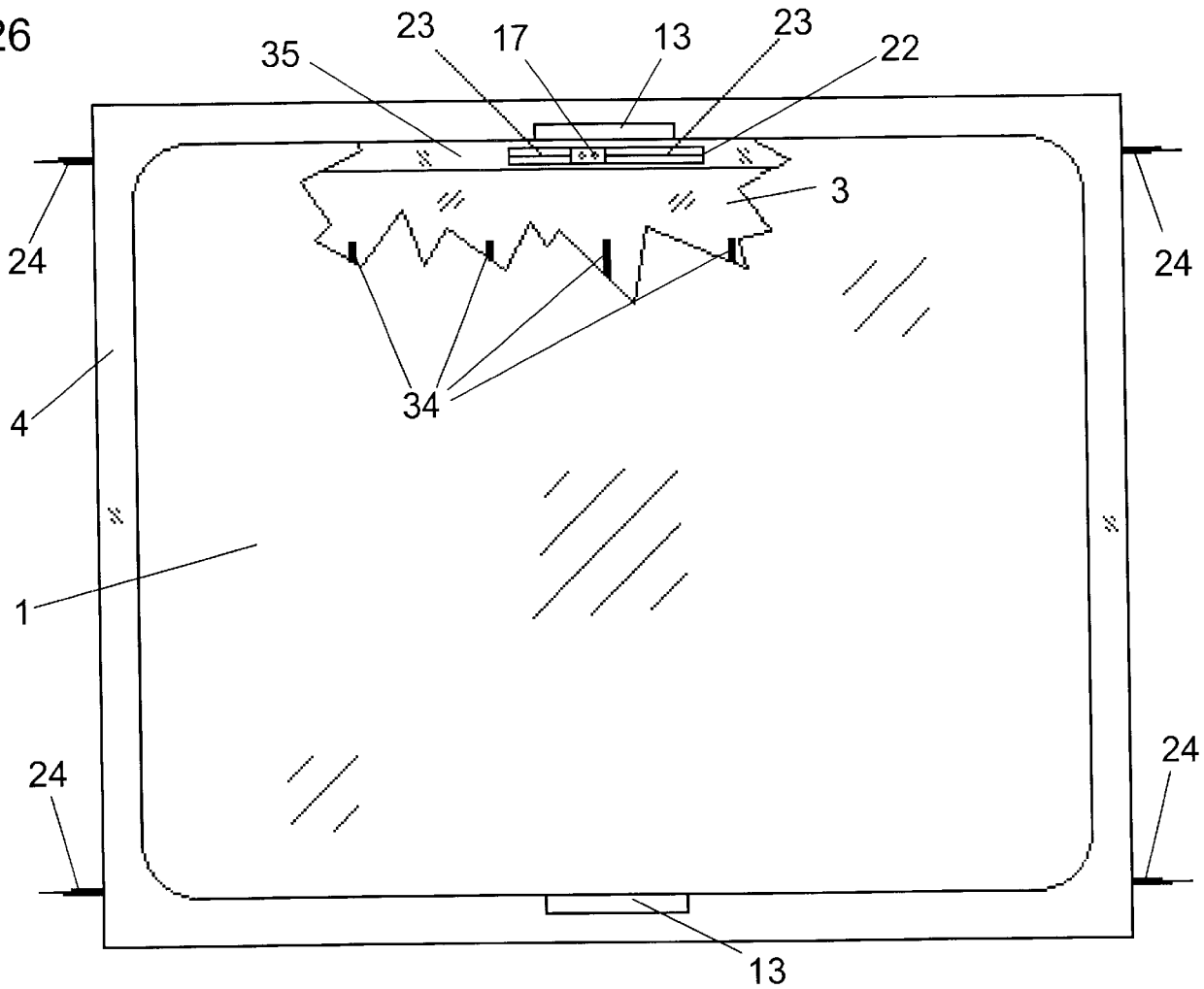
Figure 28:
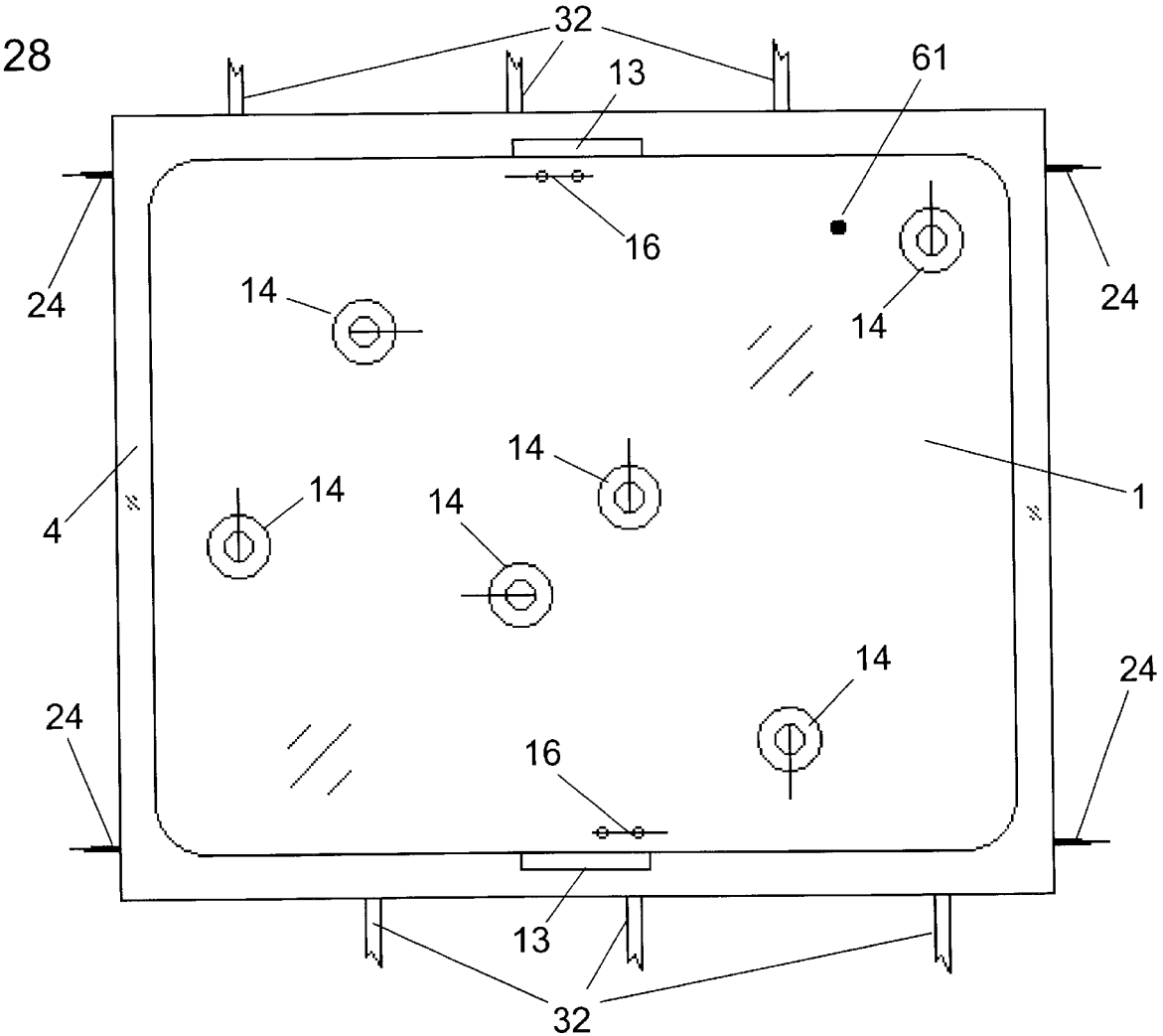
FIG. 28 shows a top view of the Suspended Playing Surface Element (SPSE) assembled with the Object Propelling Element's (OPE) and the Propelled Object Blocking Element's (POBE) upper component assemblies installed.

FIG. 22 shows an end view and FIG. 23 shows a side view of a partially exploded Suspended Playing Surface Element (SPSE). These views exhibit the playing surface raised border 4 and the majority of the playing surface assembly elevated above and positioned over the suspended playing surface framing assembly. The playing surface raised border 4, when installed, defines the playing surface and scoring area having a goal cavity 13 located at each end of the game as illustrated in FIGS. 1, 26 and 28. In addition to defining the playing surface, the playing surface raised border 4 holds a portion of the playing surface assembly in position over the SPSE framing assembly.

The playing surface 1, exhibited in FIGS. 1, 2, 3, 13, 26 and 28, is comprised of a transparent plastic sheeting top layer 5 and a plastic sheeting bottom layer 7. Sandwiched between the transparent plastic sheeting top layer 5 and the plastic sheeting bottom layer 7 is a thin printable sheeting 6 that may be printed and/or colored to provide a variety of playing surfaces. In this embodiment the printable sheeting 6 is illustrated white and unprinted. At each end of the playing surface 1, located within the goal cavity portions of the playing surface raised border 4, two goal cavity 13 openings are cut through the assembled playing surface 1, exhibited as top views in FIGS. 25, 26 and 28. Two frame angles 11 are notched below the goal cavity openings to provide an unobstructed opening below the playing surface 1, exhibited as a top view in FIGS. 24 and 25. These goal cavity openings allow the playing object (i.e. puck) to fall from the playing surface 1 when a goal is scored.

Figure 24:
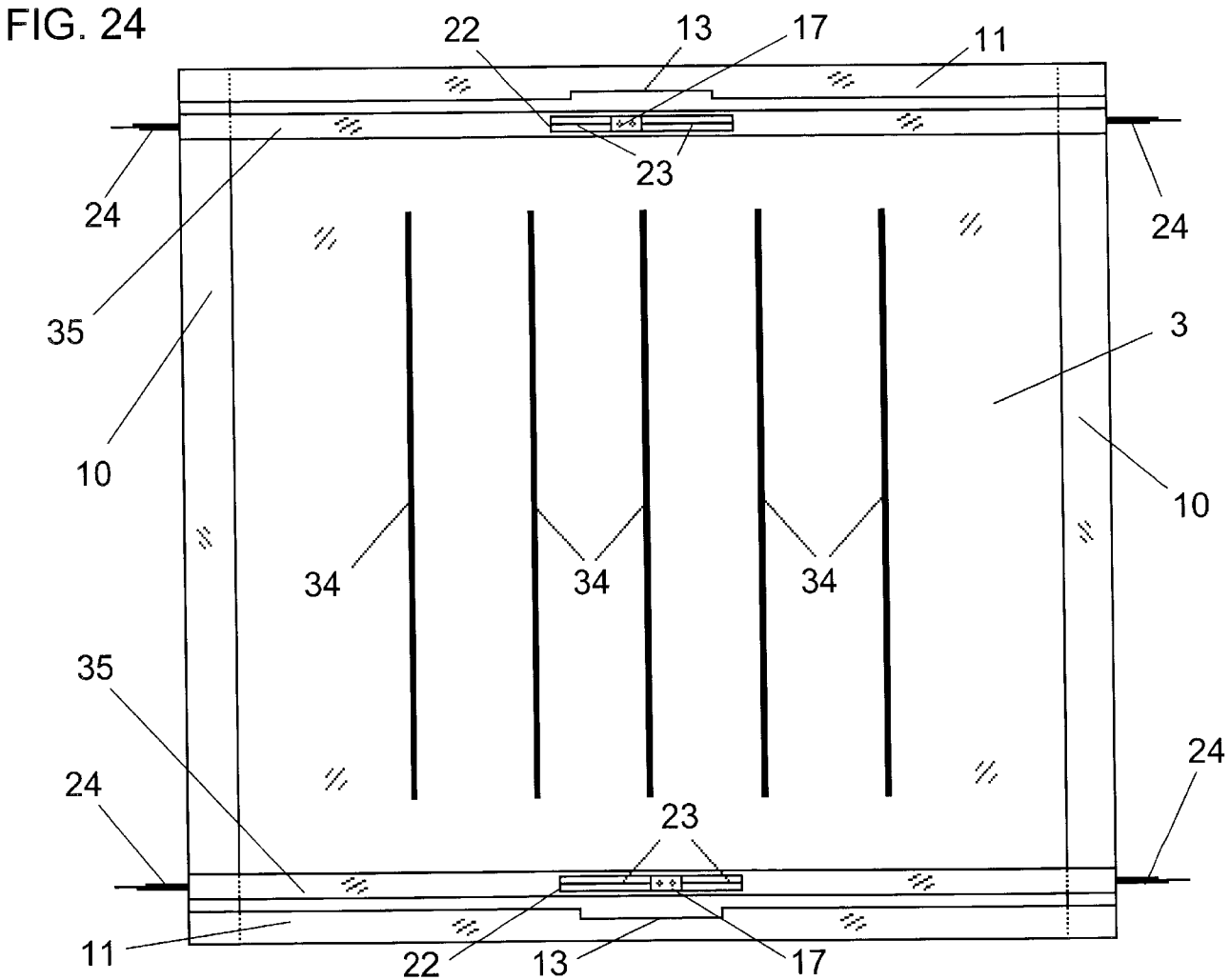
FIG. 24 shows a top view of the Suspended Playing Surface Element's (SPSE) framing assembly.

The plastic sheeting bottom layer 7 has the same exterior dimension as the playing surface framing assembly, exhibited as a top view in FIG. 24. The top surface of the sides of the plastic sheeting bottom layer 7 are attached to the interior surface of securing angles 8 which extend downward. The securing angles 8 are attached to frame sides 10 clamping the sides of the plastic sheeting bottom layer 7 to the framing assembly. This assembly is exhibited in an elevated position in FIG. 22, secured to the framing assembly in FIG. 23 and as a top view attached to the framing assembly in FIG. 25. Two securing strips 9 having the same thickness as the securing angles 8 are attached through the top of the two ends of the plastic sheeting bottom layer 7 into frame angles 11, clamping the ends of the plastic sheeting bottom layer 7 to the framing assembly. A view of the securing strips 9 elevated and positioned over the framing angles 11 of the framing assembly are exhibited in FIGS. 22 and 23. A top view of the securing strips 9, which run the entire length of each end flush to the securing angle 8, are displayed attached to the framing assembly in FIG. 25. The plastic sheeting bottom layer 7 is now secured to the framing assembly leaving a substantially square opening having a depth equivalent to the thickness of the securing angles 8 and the securing strips 9. The printable sheeting 6 and the transparent plastic sheeting top layer 5 have exterior dimensions that allow them to fit loosely within this opening. The printable sheeting 6 is placed within this opening, is covered with the transparent plastic sheeting top layer 5 and is held in place with the playing surface raised border 4 which overlays them and extends downward over the framing assembly sides completing the playing surface 1 assembly. Elevated views exhibiting the positioning of this assembly are illustrated in FIGS. 22 and 23. Top views of the playing surface 1 installed are illustrated in FIGS. 26 and 28.

This playing surface 1 assembly, in addition to providing a smooth top and bottom suspended sliding surface, was also designed to provide a simple and easy procedure for changing playing surface simulations (i.e. hockey, soccer field etc), to provide a surface for advertisements (commercial applications) and a surface that may be personally customized by simply changing or modifying the printable sheeting 6.

The procedure to remove the printable sheeting 6 is as follows: lift and remove the playing surface raised border 4 from the framing assembly; lift and remove the transparent plastic sheeting top layer 5; lift and remove the printable sheeting 6. To install a new printable sheeting 6 the procedure is reversed.

The framing assembly that the playing surface 1 is mounted to is comprised of two thick structurally sound frame sides 10 that extend the length of the suspended playing surface base 3 sides. The height of the frame sides 10 is slightly greater then the height of the OPE's impact ring 38. This height is sufficient enough as to create a space between the bottom of the OPE's lower component 15 and the top of the playing surface base 3 when magnetically coupled to the OPE's upper component 14 through the playing surface 1. A view exhibiting this spacing is illustrated in FIG. 3.

At each end of the frame sides 10 a frame angle 11 is flush mounted extending downward. The frame angles 11 are of sufficient length so that when they are mounted to the frame side 10 ends they form a substantially square frame structure that has the same outside dimensions of the playing surface base 3. This assembly is also exhibited as a top view in FIG. 24. The portion of frame angle 11 that extends downward over the ends of the frame sides 10 has an angular depth dimension sufficient enough to create control rod openings 33 between the top of the playing surface base 3 and the bottom of the frame angle 11 as illustrated in FIGS. 1, 13 and 22.

Spanning from side to side across the square frame structure are two substantially square framing channels 35 that are flush mounted to the top of the frame side 10. The framing channels 35 have an exterior channel dimension adequate enough to insure that, when mounted, they are sufficiently elevated above the playing surface base 3 so that they do not obstruct the control rod openings 33. Their positioning within the framing assembly is illustrated with a broken line as an end view in FIG. 22, as a side view with partially broken lines in FIG. 23 and as top views in FIGS. 24, 25, and 26. As previously described, the framing channels 35 serve a dual purpose, in addition to being part of the framing assembly they also house part of the POBE's lower component assembly. The two framing channels 35 are mounted to the frame sides 10 in a fashion as to create framing channel cable openings 59 at the sides of framing assembly to allow the POBE's cable plus jacketing 24 to exit the frame sides. A side view of two of the four framing channel cable openings 59 is exhibited in FIG. 23. The cables plus jacketing 24 are exhibited exiting the framing assembly as a perspective view in FIG. 1, an end view in FIG. 13, and as a top view in FIGS. 24, 25, 26 and 28.

The framing assembly is positioned over the playing surface base 3 that is made of a rigid flat material with a smooth top surface having the same exterior dimensions as the framing assembly and a thickness sufficient enough as to provide a mounting surface for pivoting hinges 12. One side of the frame sides 10 is attached to the playing surface base 3 with the pivoting hinges 12, exhibited as end views in FIGS. 13 and 22 and as a side view in FIG. 23. Top views of the playing surface base 3 are also illustrated in FIGS. 24, 25, 26 and 27.

Utilizing this hinged mounting design the framing assembly can be pivoted upward from the playing surface base 3 to provide a simple and easy method of installing or removing of the OPE's lower component assemblies 15. The lower component assemblies installed on the playing surface base 3 are exhibited in FIG. 27 as an unobstructed top view with the framing assembly removed.

Figure 27:
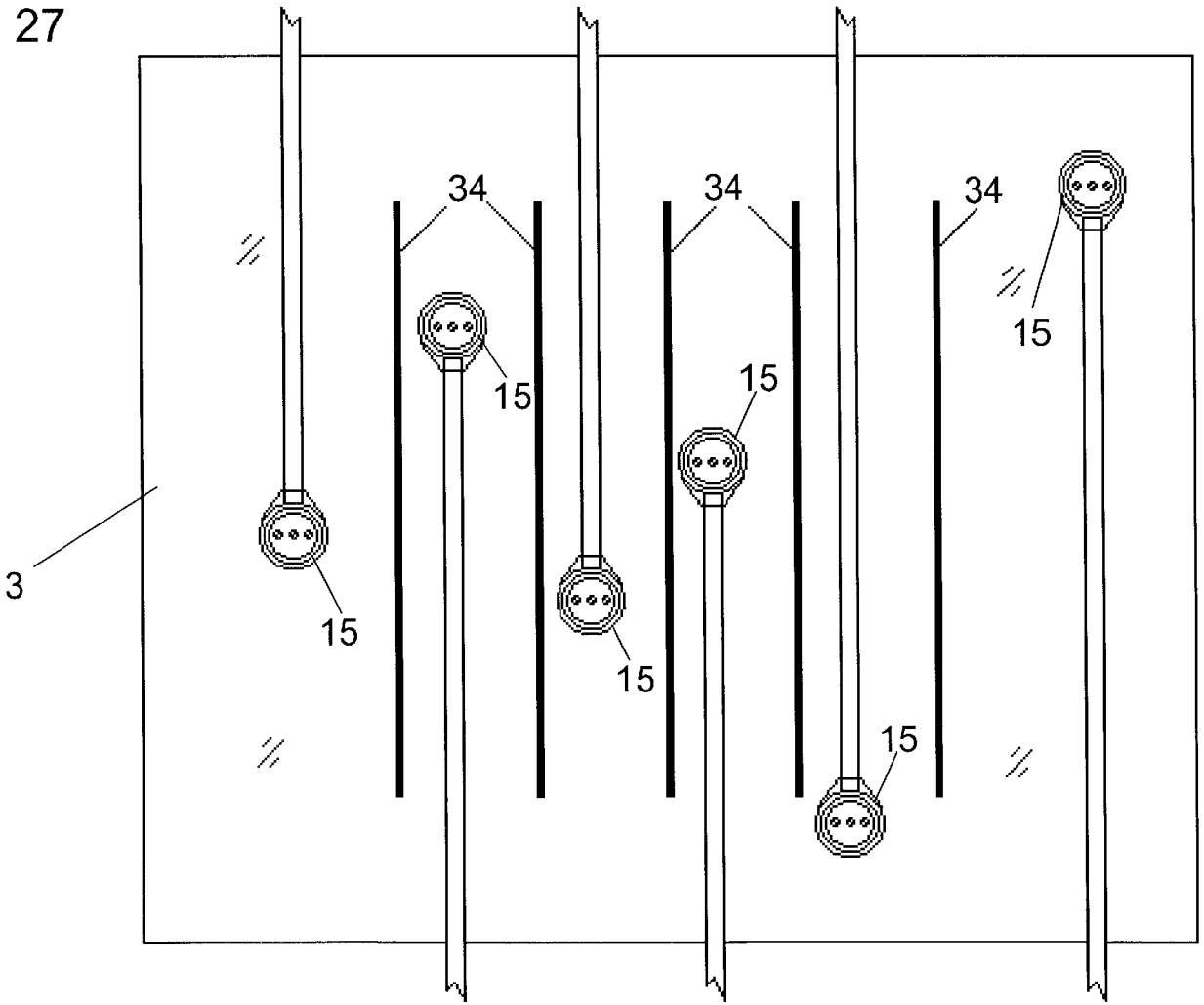
FIG. 27 shows an unobstructed top view of the Suspended Playing Surface Element's (SPSE) base and segments showing the Object Propelling Element's (OPE) lower component assemblies installed.

In this embodiment five segments 34 made of a rigid material having a thickness sufficient enough as to provide a mounting surface are exhibited extending upward to the bottom of the playing surface 1. The segments 34 are attached perpendicular to the top of the suspended playing surface base 3 and run parallel to one another to provide zones for the OPE's lower component assemblies 15 to move. FIG. 27 shows a top view illustrating the OPE's lower component assemblies 15 installed within these zones and the positioning of the segments 34 mounted to the top of the playing surface base 3. An end view of the segments 34 exhibiting their positioning in relation to the control rod openings 33 is exhibited in FIG. 13. In FIG. 22 an end view of the segments 34 is illustrated with broken lines to exhibit their elevation within the framing assembly. These segments are also displayed as a top view in FIGS. 24, 25 and 26, illustrating their positioning within the frame assembly and under the installed playing surface 1.

In this embodiment, the segments 34 provide zones for the OPE's lower components 15 to travel, however, they may be removed to allow the OPE's lower components 15 to travel the full length and width of the framing assembly and interact with one another.

The Suspended Playing Surface Element (SPSE) is designed to provide a simple and easy procedure for the installation of the Object Propelling Elements (OPE). To install the OPE's lower component assemblies 15 within the framing assembly the hinged SPSE framing assembly is pivoted upward from the suspended playing surface base 3 to provide unobstructed access. The OPE's lower component assemblies are positioned on the playing surface base 3 within their zones. In this embodiment six lower component assemblies 15 are illustrated, as shown in FIG. 27. The hinged framing assembly is pivoted back to lay flush on the playing surface base 3. The OPE's upper component assemblies 14, as exhibited in FIGS. 1 and 28, can now be magnetically coupled through the playing surface 1 to the OPE's lower component assemblies 15, exhibited in FIG. 27.

Figure 25:
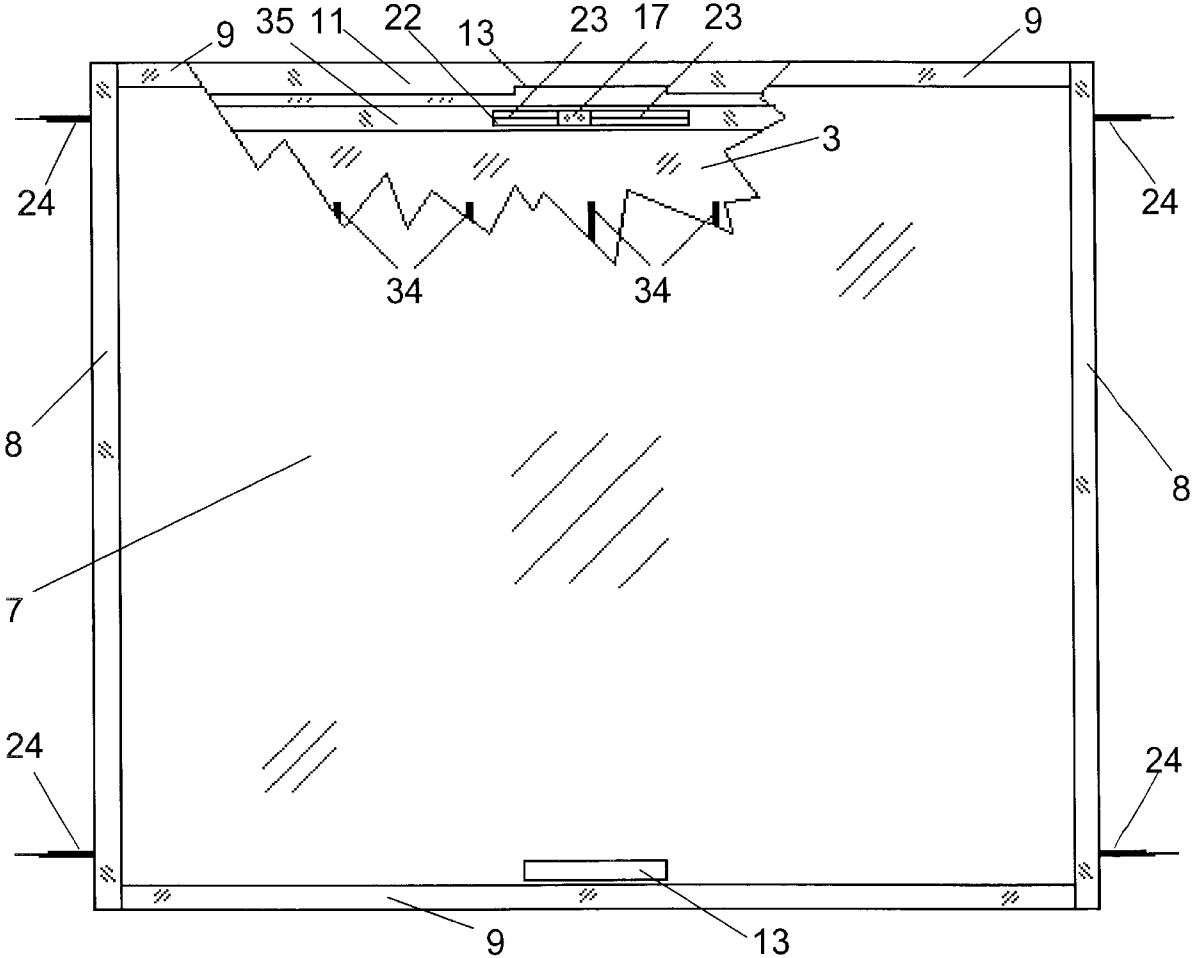
FIGS. 25 and 26 show top cutaway views of the Suspended Playing Surface Element (SPSE).

The two POBE's upper component assemblies 16, exhibited in FIGS. 1 and 28, can now be magnetically coupled through the playing surface 1 to the POBE's lower component assemblies 17 exhibited in FIG. 24, 25 and 26.

FIG. 24 is a top view of the previously described framing assembly showing the two frame sides 10 secured to the two frame angles 11 and the two framing channels 35, overlaying the playing surface base 3. Five segments 34 are illustrated secured to the playing surface base 3 within the framing assembly. The two POBE lower component assemblies 17 are exhibited within the channel openings 22, positioned in front of the goal cavities 13. The POBE lower component assemblies 17 cables 23 are also illustrated positioned within the framing channel openings 22. A view of the four cables plus jacketing 24 of the POBE's lower component assembly exiting the framing assembly is also exhibited.

FIG. 25 is a top view of the previously described plastic sheeting bottom layer 7 attached to the framing assembly with the two securing angles 8 and the two securing strips 9. A portion of one end of the plastic sheeting bottom layer 7 is cutaway to show its positioning over the segments 34 that are attached to the playing surface base 3, the frame angle 11, the goal cavity 13, the framing channel 35 and the framing channel opening 22 with the POBE's lower component assembly's 17, cables 23, installed within. A view of the goal cavity 13 at the opposite end is also illustrated. A view of the four cables plus jacketing 24 of the POBE's lower component assembly exiting the framing assembly is also exhibited.

FIG. 26 is a top view of the previously described assembled playing surface 1 and the playing surface raised border 4 installed. A portion of one end of the playing surface 1 is cutaway to show it's positioning over the segments 34 that are attached to the playing surface base 3. The framing channel 35 and framing channel opening 22 with the POBE's lower component assembly 17 and cables 23 are exhibited installed and positioned in front of the goal cavity 13. A view of the goal cavity 13 at the opposite end is also illustrated. The four cables plus jacketing 24 of the POBE's lower component assembly are also shown exiting below the playing surface raised border 4.

FIG. 27 is a top view of the previously described playing surface base 3 with the suspended playing surface framing assembly removed. This view shows the OPE's lower component assemblies 15 installed within the zones created when the segments 34 are attached.

FIG. 28 is a top view of the SPSE showing the OPE's upper component assemblies 14 (without figurines attached) magnetically coupled, through the playing surface 1, to the OPE's lower component assemblies 15 illustrated in FIG. 27. The OPE's lower component assemblies control rods 32 are also exhibited extending outwardly at each end of the SPSE. In front of the goal cavities 13, located at each end of the playing surface 1, the POBE's upper component assemblies 16 (without figurines attached) are shown magnetically coupled, through the playing surface 1, to their lower component assemblies 17 exhibited in FIG. 24. Also shown is a playing object 61 (i.e. puck) on the playing surface 1, and the four cables plus jacketing 24 of the previously described POBE's lower component assembly exiting the SPSE below the playing surface raised border 4.

As illustrated in FIG. 1 the game plays as follows: With all the elements of this invention installed the SPSE is placed on a table or pedestal (not shown) with the two rotating foot mechanisms 28 positioned on the floor at each end of the game. A playing object 61 (i.e. puck) is placed on the playing surface 1. One or more game operators are positioned at each end of the game (not shown). The game operators move the control rods 32 in and out, and from side to side moving the OPE's upper component assemblies 14 (i.e. playing piece) over the playing surface 1 to gain control, move and position the playing object 61. The game operator may also rotate the control rod 32 in turn rotating the OPE's upper component assembly 14 to either pass or propel the playing object 61 toward the opposing goal cavity 13. The opposing game operator positions the POBE upper component assembly 16 (i.e. goaltender), which moves from side to side in front of the goal cavity 13, by rotating the rotating foot mechanism 28 to block the playing object 61 from entering the goal cavity 13. The object of the game is to propel the playing object 61 past the opposing game player's POBE upper component assembly 16 into the goal cavity 13.

Although the present invention has been described with reference to a tabletop hockey game as the preferred embodiment, it is to be understood that the embodiments are merely illustrative of the principles and application of the present invention. It is therefore to be understood that numerous modifications may be made, and other arrangements may be devised without departing from the spirit and scope of the present invention as defined by the claims.

These and other variations and combinations of the features described above can be utilized without departing from the present invention as defined by the claims. As such, the foregoing description of the preferred embodiments should be taken by way of illustration rather than by way of limitation of the claimed invention.

What we claim as our invention is:

1. A game comprising: a suspended playing surface element, including a substantially planar, layered, smooth playing surface assembly defined by a raised border that includes at least one goal cavity, suspended by a framing assembly over a base; one or more object propelling element actuators located under the bottom of said playing surface movable and rotatable by a control rod, said object propelling element actuator including three first magnets; one or more object propelling elements, including a striking arm and figurine, movable and rotatable over the top of said playing surface, said object propelling element including three second magnets, wherein the first and second magnets couple through said playing surface so that movements of said object propelling element actuator result in corresponding movements of said object propelling element; one or more propelled object blocking element actuators movable by cables connected to a rotating foot mechanism, from side to side, under the bottom of said playing surface in front said goal cavity, said propelled object blocking element actuator including two first magnets; a propelled object blocking element, including a blocking arm and figurine, movable over the top of said playing surface, said propelled object blocking element including two second magnets, wherein the first and second magnets couple through said playing surface so that movement of said propelled object blocking element actuator results in the corresponding movement of said propelled object blocking element.

2. A game as claimed in claim 1, wherein said object propelling element actuator is movable in any direction below said playing surface in a plane substantially parallel to the bottom of said playing surface.

3. A game as claimed in claim 1, wherein said object propelling element actuator further includes a magnet rotor, including two similarly poled first magnets peripherally implanted diametrically opposite one another, rotatable about an axis extending in a direction substantially perpendicular to the bottom of said playing surface around one centrally implanted oppositely polled first magnet.

4. A game as claimed in claim 3, wherein said centrally implanted first magnet protrudes upwardly from said magnet rotor.

5. A game as claimed in claim 1, wherein said object propelling element further includes a magnet rotor and a magnet housing, said magnet rotor including two similarly poled second magnets peripherally implanted diametrically opposite one another, rotatable about an axis extending in a direction substantially perpendicular to the top of said playing surface around one centrally located oppositely polled second magnet implanted within said magnet housing.

6. A game as claimed in claim 5, wherein said centrally located second magnet implanted within said magnet housing extends below said magnet rotor.

7. A game as claimed in claim 1, wherein said object propelling element actuator's said first magnets are in substantial alignment with said object propelling element's said second magnets.

8. A game as claimed in claim 7, wherein said object propelling element actuator's said first magnets are polled to attract to said object propelling element's said second magnets.

9. A game as claimed in claim 1, wherein rotatable movement of said object propelling element actuator results in corresponding rotation of said object propelling element, when magnetically coupled through said playing surface.

10. A game as claimed in claim 1, wherein said object propelling element includes said striking arm, extending above and outwardly in a direction substantially perpendicular to the top of said playing surface.

11. A game as claimed in claim 10, wherein said striking arm mounts to said object propelling element with an elastic mounting band.

12. A game as claimed in claim 11, wherein said elastic mounting band is configured to stretch upon rotation of said object propelling element creating additional forward striking momentum.

13. A game as claimed in claim 1, wherein said object propelling element includes a figurine, said figurine including a slotted base enabling said figurine to friction mount to said striking arm.

14. A game as claimed in claim 1, wherein said control rod connects to said object propelling element actuator providing movement and rotation.

15. A game as claimed in claim 1, wherein said control rod has a first end connected to said object propelling element actuator and a second end extending beyond the end of said framing assembly.

16. A game as claimed in claim 15, wherein said control rod is unfixed to said framing assembly and is movable in all directions in a plane substantially parallel to said playing surface.

17. A game as claimed in claim 1, wherein movement of said control rod results in movement of said object propelling element actuator in turn resulting the corresponding movement of said object propelling element, when magnetically coupled through said playing surface.

18. A game as claimed in claim 1, wherein said control rod is rotatable vertically in a plane extending in a direction substantially perpendicular to the top of said playing surface.

19. A game as claimed in claim 18, wherein said control rod connects to said object propelling actuator further including a gear train mounted to a protective impact ring converting vertical rotation of said control rod to a horizontal rotation of said object propelling element actuator.

20. A game as claimed in claim 1, wherein said propelled object blocking element actuator is movable from side to side, within said framing assembly, in front of said goal cavity, below and in a plane substantially parallel to the bottom of said playing surface.

21. A game as claimed in claim 1, wherein said propelled object blocking element actuator, including two first magnets, is movable by said cables having first ends connected thereto, said cables having second ends connected remotely to said rotating foot mechanism linking said propelled object blocking element actuator to said rotating foot mechanism.

22. A game as claimed in claim 21, wherein said rotating foot mechanism further includes a cable pulling arm having the second ends of said cables attached thereto.

23. A game as claimed in claim 22, wherein rotation of said rotating foot mechanism pulls said cables, in turn moving said propelled object blocking element actuator.

24. A game as claimed in claim 1, wherein said propelled object blocking element includes two second magnets, in substantial alignment with, and polled to attract to said propelled object blocking element actuator's two first magnets.

25. A game as claimed in claim 1, wherein rotation of said rotating foot mechanism pulls said cables in turn moving said propelled object blocking element actuator, resulting in a corresponding movement of said propelled object blocking element, when magnetically coupled through said playing surface.

26. A game as claimed in claim 1, wherein said propelled object element further includes a blocking arm that extends above and to one side in a direction substantially perpendicular to the top of said playing surface.

27. A game as claimed in claim 26, wherein said blocking arm includes a figurine, said figurine including a slotted base enabling said figurine to friction mount to said blocking arm.

28. A game as claimed in claim 1, wherein said playing surface assembly further includes a first layer having a smooth bottom surface attached to said framing assembly, a second removable layer of thin printable sheeting overlying said first layer, and a third removable transparent layer having a smooth top surface overlying said second layer, said second and third layers held in position over said first layer with said raised border.

29. A game as claimed in claim 1, wherein said playing surface is in alignment with said base in a plane substantially parallel to the bottom of said playing surface, suspended and elevated by said framing assembly over said base providing a space therebetween.

30. A game as claimed in claim 29, wherein said object propelling element actuator is movable in the space between said playing surface and said base.

31. A game as claimed in claim 1, wherein said framing assembly further includes pivoting hinges attaching one side of said framing assembly to said base.

32. A game as claimed in claim 31, wherein said framing assembly pivots upward from said base.

33. A game as claimed in claim 1, wherein said base further includes segments attached thereto, providing a zone in which said object propelling element actuator may travel.

* * * * *